US009642767B1

(12) United States Patent
Kavanagh et al.

(10) Patent No.: US 9,642,767 B1
(45) Date of Patent: May 9, 2017

(54) PERSONAL MOBILITY DEVICE

(71) Applicant: EKT LLC, Brookyn, NY (US)

(72) Inventors: Patricia Kavanagh, Brooklyn, NY (US); Colin Touhey, Brooklyn, NY (US); Henry Ebbott-Burg, New York, NY (US); Mario A. Turchi, Tenafly, NJ (US); Michael Bambino, Sunny Side, NY (US); Robert Joachim, Glen Rock, NJ (US)

(73) Assignee: EKT LLC, Brooklyn, NY (US)

( * ) Notice: Subject to any disclaimer, the term of this patent is extended or adjusted under 35 U.S.C. 154(b) by 0 days.

(21) Appl. No.: 15/282,365

(22) Filed: Sep. 30, 2016

Related U.S. Application Data

(60) Provisional application No. 62/351,097, filed on Jun. 16, 2016.

(51) Int. Cl.
*A61H 3/04* (2006.01)
*A61H 3/00* (2006.01)

(52) U.S. Cl.
CPC ..... *A61H 3/04* (2013.01); *A61H 3/00* (2013.01); *A61H 2003/046* (2013.01)

(58) Field of Classification Search
CPC ..... B62B 7/062; B62B 7/08; B62B 33/0078; A61H 3/04; A61H 3/00
See application file for complete search history.

(56) References Cited

U.S. PATENT DOCUMENTS 4,832,354 A * 5/1989 LaFreniere ..... B60N 2/2848 280/30
5,716,063 A 2/1998 Doyle et al.
6,152,476 A * 11/2000 Huang ..... B62B 7/08 188/20
7,222,874 B1 * 5/2007 Liu ..... B60T 7/102 188/19
7,229,092 B1 6/2007 Parker et al.
7,798,500 B2 * 9/2010 Den Boer ..... B62B 7/062 280/47.34
8,087,687 B2 * 1/2012 Murdock ..... A61G 5/042 280/642

(Continued)

FOREIGN PATENT DOCUMENTS

SE 514388 2/2001

OTHER PUBLICATIONS

International Search Report and Written Opinion for PCT/US2016/054880, dated Dec. 15, 2016.

*Primary Examiner* — Hau Phan
(74) *Attorney, Agent, or Firm* — Wiley Rein LLP

(57) ABSTRACT

A personal mobility device includes a pair of rear legs and a pair of front legs pivotably connected to the rear legs via a pair of hubs. A handle, having a loop shape and including a grip portion, is slidably mounted within the pair of hubs so that the height of the grip can be adjusted. The hubs lock the front and rear legs in both an open (unfolded) and closed (folded) configuration. By sliding the handle downward through the hubs, the legs are unlocked from the open position and allowed to pivot until locked in the closed configuration. Conversely, by sliding the handle upward through the hubs, the legs are unlocked from the closed position and allowed to pivot until locked in the open configuration.

22 Claims, 30 Drawing Sheets

(56) References Cited

U.S. PATENT DOCUMENTS

| | | | | |
|---|---|---|---|---|
| 8,205,907 | B2 * | 6/2012 | Chicca | B62B 7/062 280/642 |
| 8,226,110 | B2 * | 7/2012 | Liao | B62B 7/062 280/47.38 |
| 8,714,581 | B2 * | 5/2014 | Fritz | B62B 7/08 280/642 |
| 8,998,241 | B1 * | 4/2015 | Cheng | B62B 7/062 280/47.38 |
| 9,067,612 | B2 * | 6/2015 | Kobayashi | B60B 33/0078 |
| 2004/0222616 | A1 * | 11/2004 | Valdez | B62B 7/08 280/647 |
| 2012/0235385 | A1 | 9/2012 | Simpson et al. | |
| 2013/0076009 | A1 * | 3/2013 | Tsai | B62B 7/08 280/647 |
| 2013/0147162 | A1 * | 6/2013 | Hsu | B62B 7/062 280/647 |
| 2014/0167393 | A1 | 6/2014 | Tsai et al. | |

* cited by examiner

PERSONAL MOBILITY DEVICE

CROSS-REFERENCE TO RELATED APPLICATIONS

This application claims the benefit of U.S. provisional application No. 62/351,097, filed 16 Jun. 2016, which is hereby incorporated by reference as though fully set forth herein.

BACKGROUND

The instant disclosure relates to personal mobility devices. In particular, the instant disclosure relates to a personal mobility device that is collapsible to a compact size for storage.

Many individuals require mobility assistance, whether due to old age, disease, temporary injury, or other infirmity. Known mobility assistance devices include various types of canes, walkers, transport chairs, wheelchairs, rollators, and the like.

Extant mobility devices, however, exhibit numerous shortcomings. For example, current walkers and rollators are bulky and only foldable in one plane (e.g., they fold laterally, as do many wheelchairs, or forward, as do many rollators). This makes them difficult to transport.

Another disadvantage of extant mobility devices is their appearance. This can result in a situation where an individual who could benefit from using such device does not do so. Such individuals often cite the appearance of the device, and a concomitant fear of stigma and/or embarrassment, as the basis for their decision to forego using a mobility assistance device that might otherwise improve their quality of life.

Disadvantages are present even when an individual does elect to use a mobility assistance device. For example, extant mobile devices are heavy and complex. In many instances, the individual using the mobility assistance device may lack sufficient cognitive ability, strength, and/or dexterity to effectively manipulate the device (e.g., to lift, fold, and/or unfold the device and/or to operate caliper-style brakes). These complications may be magnified for individuals who do not have a fairly symmetrical use of their upper limbs, such as stroke victims.

BRIEF SUMMARY

Disclosed herein is a personal mobility device including: a first rear leg; a second rear leg; a first front leg pivotably connected to the first rear leg by a first hub; a second front leg pivotably connected to the second rear leg by a second hub; and a handle, having a loop shape and including a grip portion, slidably mounted within the first hub and the second hub such that a height of the grip portion is adjustable. The first hub has a first state, wherein the first rear leg and the first front leg are locked in an open configuration; a second state, wherein the first rear leg and the first front leg are locked in a closed configuration; and a third state, wherein the first rear leg and the first front leg are unlocked to pivot between the open configuration and the closed configuration. Similarly, the second hub has a first state, wherein the second rear leg and the second front leg are locked in an open configuration; a second state, wherein the second rear leg and the second front leg are locked in a closed configuration; and a third state, wherein the second rear leg and second front leg are unlocked to pivot between the open configuration and the closed configuration.

According to aspects of the disclosure, sliding the handle downwardly through the first hub toggles the first hub between the first state of the first hub and the third state of the first hub, and sliding the handle downwardly through the second hub toggles the second hub between the first state of the second hub and the third state of the second hub. Conversely, sliding the handle upwardly through the first hub can toggle the first hub between the second state of the first hub and the third state of the first hub, and sliding the handle upwardly through the second hub can toggle the second hub between the second state of the second hub and the third state of the second hub.

The first hub can include a first follower that, when depressed, toggles the first hub into the second state. Similarly, the second hub can include a second follower that, when depressed, toggles the second hub into the second state. The handle can include a first cam to depress the first follower and a second cam to depress the second follower. The first and second cams can, in turn, each include a wedge to depress the first and second followers as the handle slides downwardly through the first and second hubs and to depress the first and second followers as the handle slides upwardly through the first and second hubs.

The personal mobility device can also include: a first swiveling wheel assembly including a first wheel attached to the first front leg; and a second swiveling wheel assembly including a second wheel attached to the front rear leg, wherein the handle has a curvature such that, when the handle is slid downwardly through the first hub and the second hub, it engages the first swiveling wheel assembly and the second swiveling wheel assembly in a manner that positions the first wheel parallel to the second wheel and prevents swiveling of the first swiveling wheel assembly and the second swiveling wheel assembly.

In other aspects of the disclosure, the personal mobility device includes: a first wheel attached to the first rear leg; a second wheel attached to the second rear leg; a first brake shoe adjacent the first wheel and movable between an undeployed configuration, wherein the first brake shoe is not in contact with the first wheel, and a deployed configuration, wherein the first brake shoe is in contact with the first wheel; a second brake shoe adjacent the second wheel and movable between an undeployed configuration, wherein the second brake shoe is not in contact with the second wheel, and a deployed configuration, wherein the second brake shoe is in contact with the second wheel; a first actuator in the first hub operable to toggle the first brake shoe between the undeployed configuration and the deployed configuration; and a second actuator in the second hub operable to toggle the second brake shoe between the undeployed configuration and the deployed configuration. The first and second actuators can be coupled to the first and second brake shoes through respective first and second pluralities of pulleys.

It is also contemplated that the personal mobility device can include a seat movable between a stowed position and a use position, wherein moving the seat from the stowed position to the use position actuates the first actuator to toggle the first brake shoe into the deployed configuration and actuates the second actuator to toggle the second brake shoe into the deployed configuration. For example, the seat can be pivotably coupled to the first hub and the second hub. In addition, according to aspects of the disclosure, the first and second actuators can be biased to toggle the first and second brake shoes into their respective undeployed configurations.

In further aspects of the disclosure: the first hub includes a first grip height locking pin; the second hub includes a second grip height locking pin; and the handle includes a plurality of detents to engage the first grip height locking pin and the second grip height locking pin as the handle slides through the first hub and the second hub in order to secure the grip portion of the handle at a preset height. The handle can include: a plurality of pegs internal to the handle and respectively positioned adjacent the plurality of detents; and an actuator operable to move the plurality of pegs such that they respectively protrude outwardly from the plurality of detents, thereby preventing the first grip height locking pin and the second grip height locking pin from engaging the plurality of detents as the handle slides through the first hub and the second hub in order to adjust the height of the grip portion of the handle. At least some of the plurality of pegs can be interconnected with each other.

In other embodiments, the personal mobility further includes: a first wheel attached to the first rear leg; a second wheel attached to the second rear leg; a first brake shoe biased into engagement with the first wheel; and a second brake shoe biased into engagement with the second wheel. The first and second brake shoes can respectively engage inner, upper surfaces of the first and second wheels, such that a downward force applied to the grip portion of the handle causes the first brake shoe to disengage the first wheel and the second brake shoe to disengage the second wheel.

The handle can take the form of a closed loop. The grip portion of the handle can include a centrally-located flattened region (e.g., to enhance comfort when used as a backrest).

The foregoing and other aspects, features, details, utilities, and advantages of the present invention will be apparent from reading the following description and claims, and from reviewing the accompanying drawings.

BRIEF DESCRIPTION OF THE DRAWINGS

FIGS. 11A-11G illustrate an open, or unfolded, configuration with the seat stowed; FIGS. 12A-12G illustrate an open, or unfolded, configuration with the seat in a use position; and FIGS. 13A-13G illustrate a closed, or folded, configuration. In each case, A is a front view; B is a rear view; C is a left view; D is a right view; E is a top view; F is a bottom view; and G is a perspective view.

DETAILED DESCRIPTION

Figure 1:
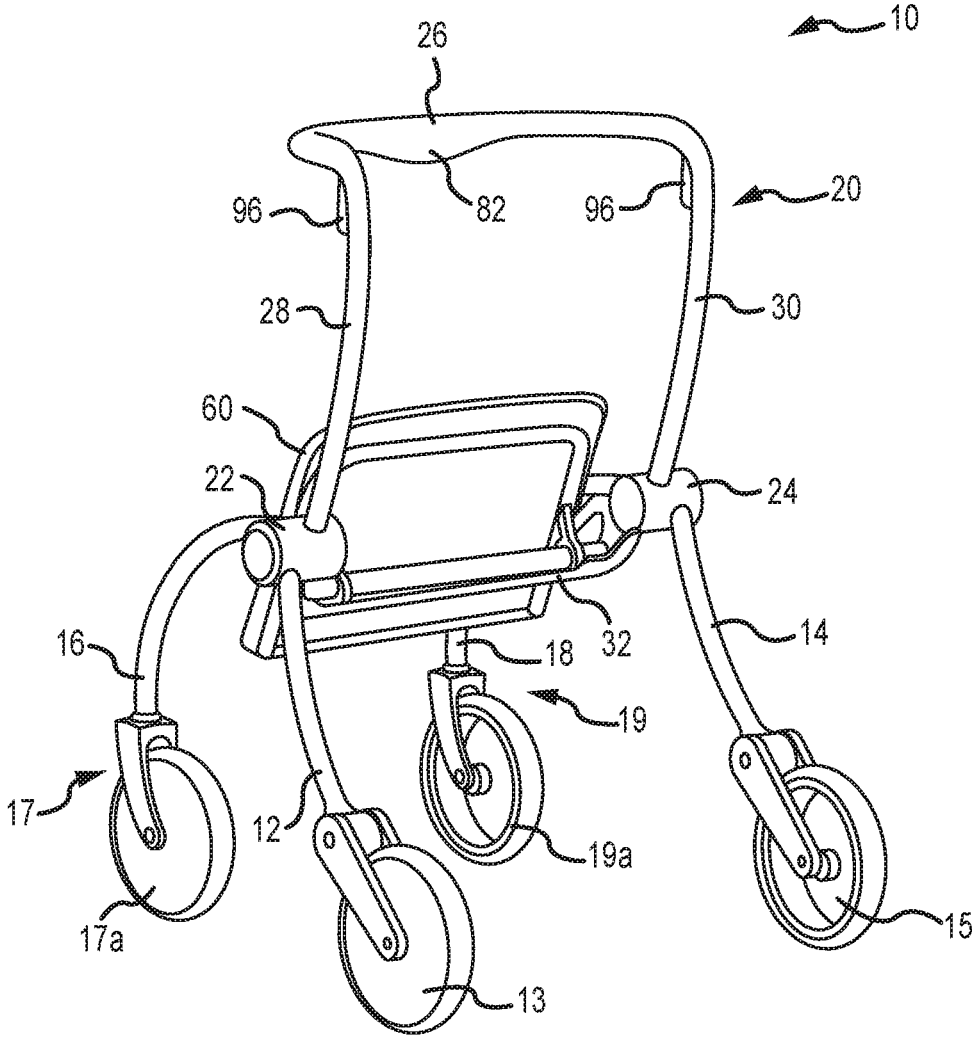
FIG. 1 is a perspective view of a personal mobility device according to aspects of the instant disclosure in an open, or unfolded, configuration, with the seat stowed.

FIG. 1 depicts a personal mobility device 10 according to embodiments of the instant disclosure. As shown in FIG. 1, personal mobility device 10 generally includes a first rear leg 12, a second rear leg 14 (which, in embodiments, can be parallel to first rear leg 12), a first front leg 16, a second front leg 18 (which, in embodiments, can be parallel to first front leg 16), and a handle 20.

First rear leg 12 includes a first rear wheel 13 attached thereto. Second rear leg 14 includes a second rear wheel 15 attached thereto. Additional aspects of first and second rear wheels 13, 15 will be described below.

A first swiveling wheel assembly 17, including a first front wheel 17*a*, is attached to first front leg 16. A second swiveling wheel assembly 19, including a second front wheel 19*a*, is attached to second front leg 18. Additional aspects of first and second swiveling wheel assemblies 17, 19 will be described below.

First rear leg 12 and first front leg 16 are pivotably connected by a first hub 22. Similarly, second rear leg 14 and second front leg 18 are pivotably connected by a second hub 24.

Handle 20 has a loop shape and includes a grip portion 26, two generally vertical members 28, 30, and a lower member 32. In certain embodiments, grip portion 26, vertical members 28, 30, and lower member 32 form a closed loop. In other embodiments, grip portion 26, vertical members 28, 30, and lower member 32 can form an open loop, such as by creating an opening in grip portion 26 that creates two distinct handholds (as opposed to the single continuous handhold shown in FIG. 1). Grip portion 26 can be coated with a material such as neoprene to enhance grip stability, comfort, and durability.

Vertical members 28, 30 of handle 20 are respectively slidably mounted in first hub 22 and second hub 24. This allows the height of grip portion 26 to be adjusted upward or downward, both to accommodate users of different heights and as part of the process of expanding and collapsing personal mobility device 10, as discussed in greater detail below.

First hub 22 has a first state in which first rear leg 12 and first front leg 16 are locked in an open configuration. Similarly, second hub 24 has a first state in which second rear leg 14 and second front leg 18 are locked in an open configuration. This open configuration (also referred to as an unfolded configuration) is shown in FIG. 1.

Figure 2:
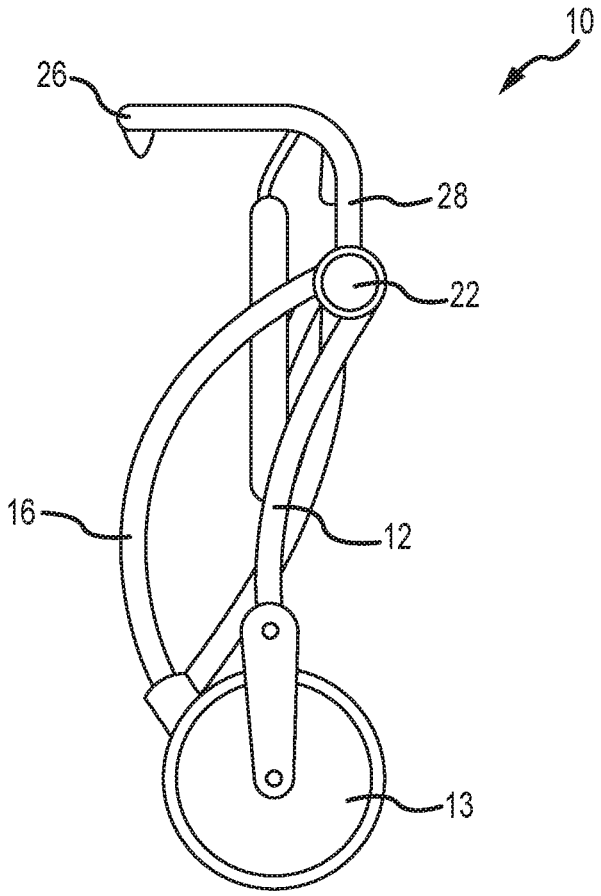
FIG. 2 is a side view of the personal mobility device shown in FIG. 1 in a closed, or folded, configuration.

First hub 22 also has a second state in which first rear leg 12 and first front leg 16 are locked in a closed configuration. Similarly, second hub 24 has a second state in which second rear leg 14 and second front leg 18 are locked in a closed configuration. This closed configuration (also referred to as a collapsed or folded configuration) is shown in FIG. 2.

First hub 22 also has a third state in which first rear leg 12 and first front leg 16 are unlocked, which allows them to pivot relative to each other in transition between the open configuration and the closed configuration and vice versa when folding and/or unfolding personal mobility device 10. Similarly, second hub 24 has a third state in which second rear leg 14 and second front leg 18 are unlocked, which allows them to pivot relative to each other in transition between the open configuration and the closed configuration and vice versa when folding and/or unfolding personal mobility device 10.

According to aspects of the disclosure, sliding handle 20 through first and second hubs 22, 24 toggles first and second hubs 22, 24 between the states described above. In particular, sliding handle 20 downwardly through first and second hubs 22, 24 toggles between the first (locked open) and third (unlocked) states, while sliding handle 20 upwardly through first and second hubs 22, 24 toggles between the second (locked closed) and third (unlocked) states. These aspects will be further described with reference to second hub 24 as depicted in FIGS. 3 and 4.

Figure 3:
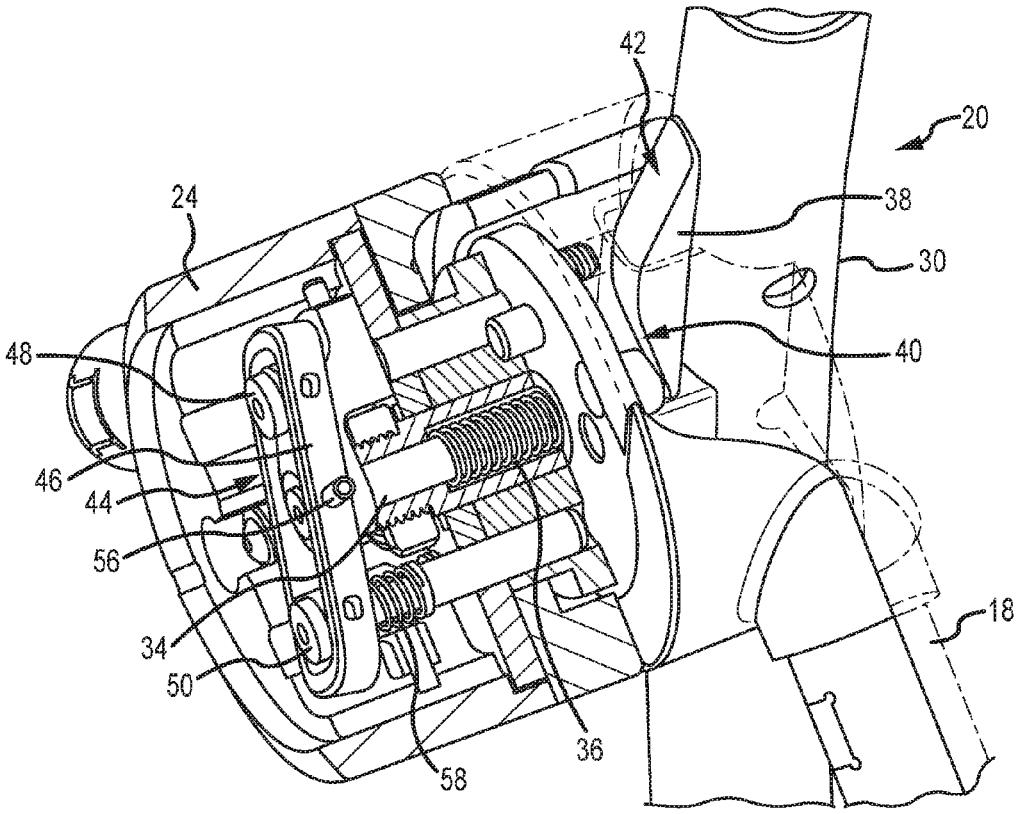
FIG. 3 is a close up, cut-away view of a hub that can be used in connection with the personal mobility device shown in FIG. 1.
Figure 4:
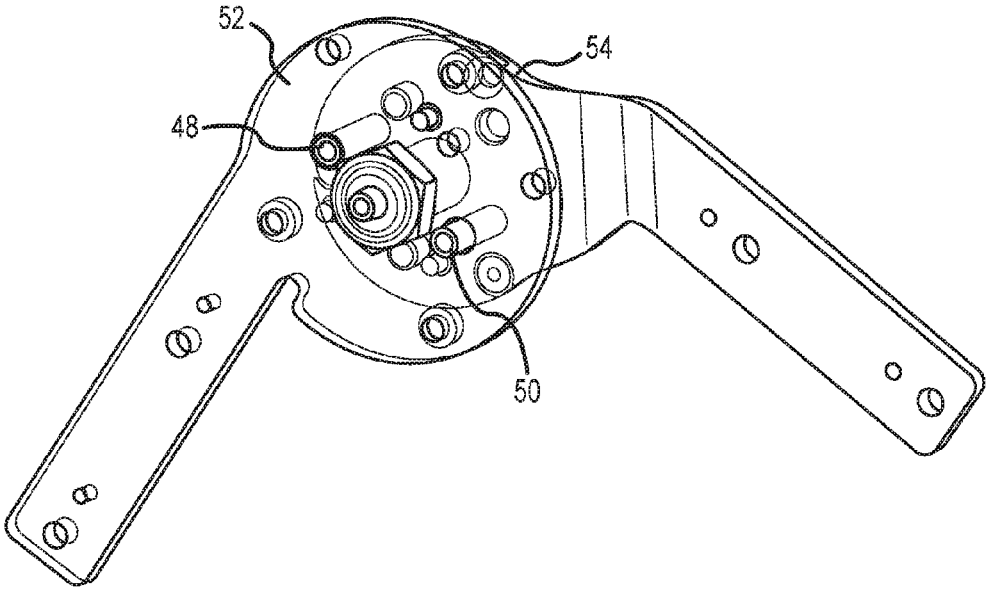
FIG. 4 depicts a pair of plates that rotate within the hub shown in FIG. 3.

As shown in FIG. 3, second hub 24 includes a follower 34 that is biased by a spring 36 into contact with vertical member 30 of handle 20. Vertical member 30 of handle 20 includes a cam 38. In turn, cam 38 includes a first wedge 40, which engages follower 34 as handle 20 slides downwardly through second hub 24. It can also include a second wedge 42 to engage follower 34 as handle 20 slides upwardly through second hub 24. Alternatively, first wedge 40 can also engage follower 34 as handle 20 slides upwardly through second hub 24.

Second hub 24 also includes a toggle mechanism 44, including a toggle arm 46 and a pair of pins 48, 50. Pins 48, 50 engage holes in plates 52, 54, shown in FIG. 4, which are attached to second rear leg 14 and second front leg 18. When either pin 48 or pin 50 is engaged with plates 52, 54, plates 52, 54 are unable to rotate relative to each other, which locks second rear leg 14 and second front leg 18 in place. Conversely, when neither pin 48 nor pin 50 is engaged with plates 52, 54, plates 52, 54 can rotate relative to each other, which allows second rear leg 14 to pivot relative to second front leg 18 in transition between the open and closed states of personal mobility device 10.

FIG. 3 depicts second hub 24 in the first (locked open) state. As handle 20 slides downwardly through second hub 24, first wedge 40 engages and depresses follower 34. This, in turn, toggles toggle arm 48 to pivot about hinge 56 (shown in FIG. 3), drawing pin 48 out of engagement with plates 52, 54, thereby unlocking second rear leg 14 and second front leg 18 to pivot relative to each other (e.g., second hub 24 is in the third state).

Meanwhile, toggle arm 48 compresses spring 58 on pin 50, which is engaged against the surface of plate 52. Compression of spring 58 arms pin 50 to engage plates 52, 54 once they are appropriately rotated (e.g., with second rear leg 14 and second front leg 18 in the closed configuration of FIG. 2), thereby placing second hub 24 in the second (locked closed) state.

As handle 20 continues to slide downwardly through second hub 24, spring 36 causes follower 34 to return to its original position, re-arming it to toggle second hub 24 from the second (locked closed) state to the third (unlocked) state.

As handle 20 slides upwardly through second hub 24, second wedge 42 engages and depresses follower 34, and the reverse process occurs to release second hub 24 from the second state into the third state and re-lock second hub 24 in the first state once plates 52, 54 are appropriately rotated (e.g., with second rear leg 14 and second front leg 18 in the open configuration of FIG. 1).

Figure 5:
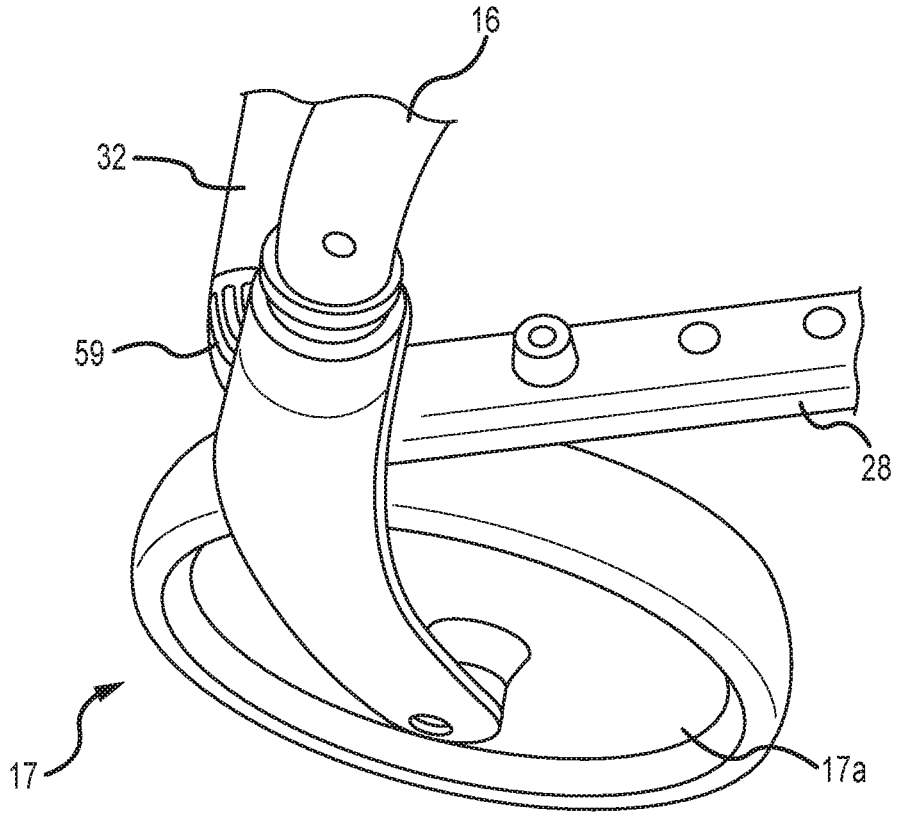
FIG. 5 illustrates engagement between the handle and the front swiveling wheel assembly of the personal mobility device shown in FIG. 1.

As seen in FIG. 1, vertical members 28 and 30 of handle 20 are curved. As handle 20 slides downwardly through first and second hubs 22, 24, this curvature allows handle 20 to engage first and second swiveling wheel assemblies 17, 19 in a manner that prevents swiveling wheel assemblies 17, 19 from swiveling and that positions first and second front wheels 17*a*, 19*a* parallel to one another. In addition, elbow 59 at the joint between vertical member 28 and lower member 32 of handle 20 wedges against first front wheel 17*a* to prevent it from turning (that is, elbow 59 operates as a brake on first front wheel 17*a*). This is shown, with respect to first swiveling wheel assembly 17 for purposes of illustration, in FIG. 5. This configuration facilitates the folding of personal mobility device 10 by allowing first and second front wheels 17*a*, 19*a* to nest interior to first and second rear wheels 13, 15 as shown in FIG. 2.

Figure 6:
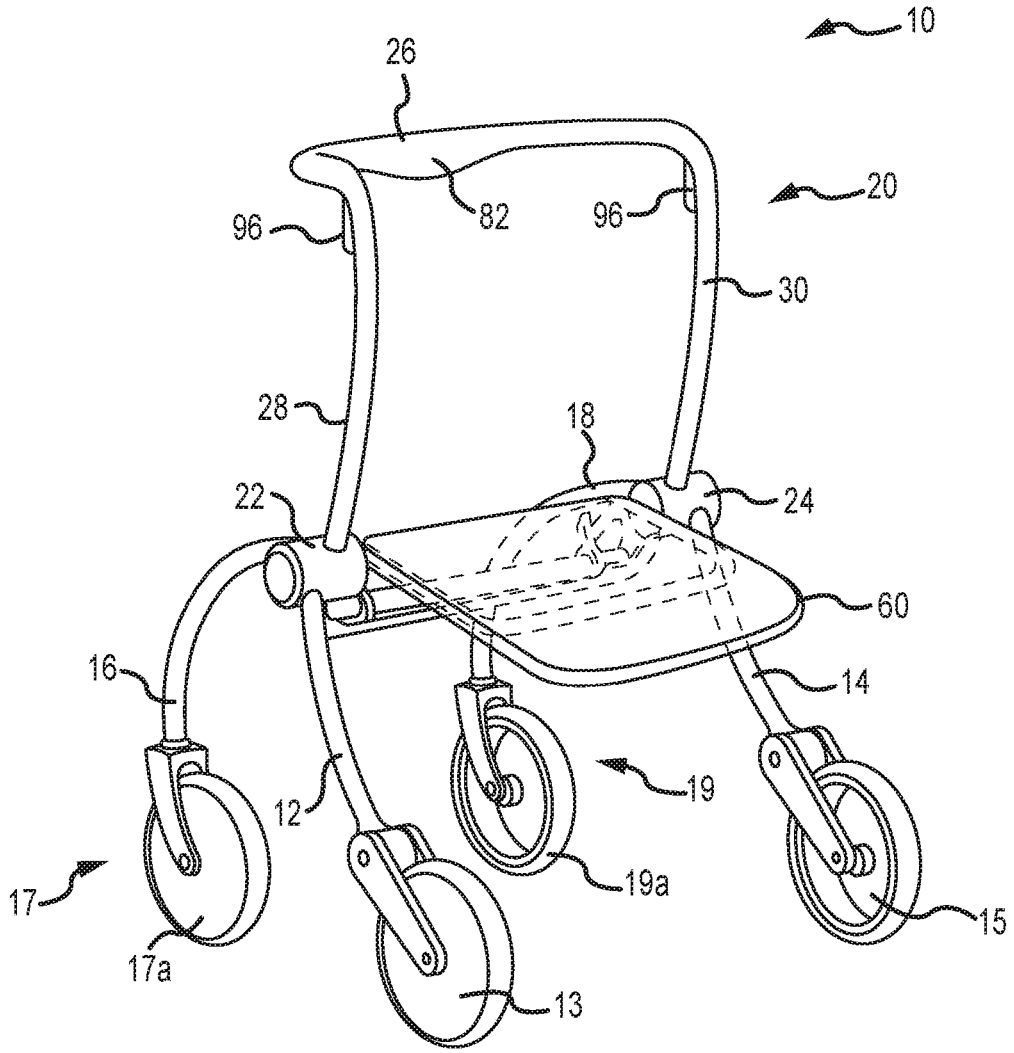
FIG. 6 is a perspective view of the personal mobility device shown in FIG. 1 in an open, or unfolded, configuration, with the seat in a use position.

Returning again to FIG. 1, embodiments of personal mobility device 10 can include a seat 60. FIG. 1 depicts seat 60 in a stowed position. FIG. 6 depicts seat 60 in a use position.

To exchange seat 60 between the stowed position of FIG. 1 and the use position of FIG. 6, it can be pivotably coupled to first hub 22 and second hub 24. In embodiments of the disclosure, this coupling is provided by a four-bar linkage 62 at each of first and second hubs 22, 24, as shown in FIG. 7 with respect to first hub 22.

Figure 7:
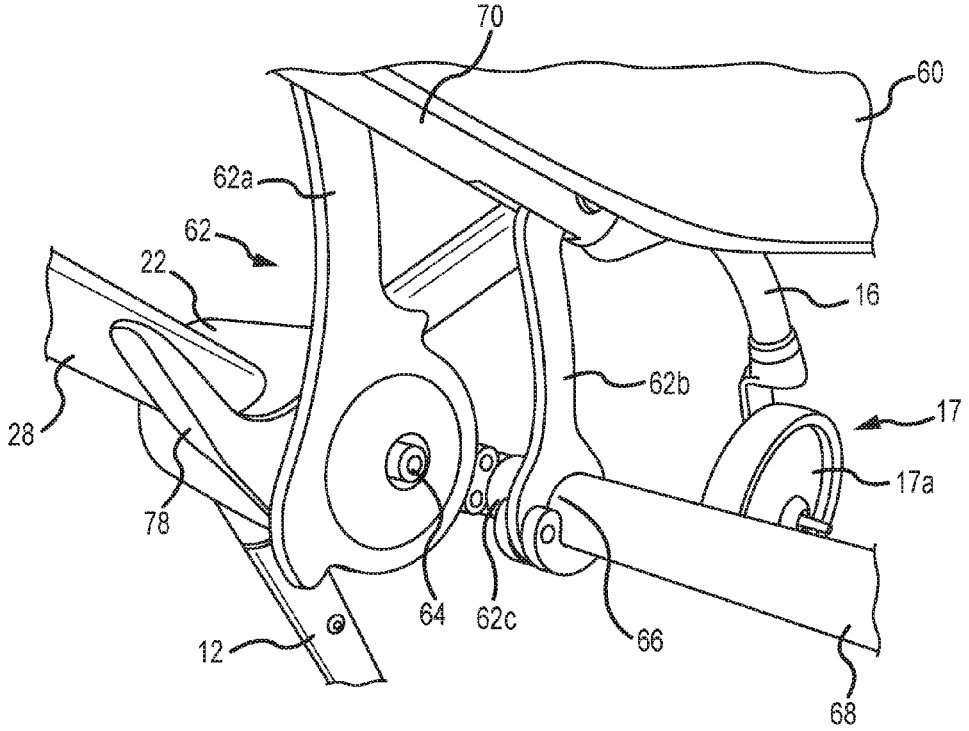
FIG. 7 is a close up view of a mechanism to move the seat of the personal mobility device of FIG. 1 between its stowed position and its use position.

As those of ordinary skill in the art will understand, two of the four bars 62*a*, 62*b* in the linkage 62 are physical bars, and a third bar 62*c*, shown in phantom in FIG. 7, is a virtual bar defined between the pivot joint 64 between first bar 62*a* and first hub 22 and the pivot joint 66 between second bar 62*b* and member 68. Frame 70 of seat 60 forms the fourth bar of four-bar linkage 62.

Advantageously, the use of four-bar linkage 62, as opposed to a simple hinge as in extant mobility devices, allows seat 60 to move further forward relative to first and second rear legs 12, 14 when in the stowed position. This, in turn, allows a user to move further forward within the footprint of personal mobility device 10 during use, which enhances stability and reduces the force that a user must apply in order to move personal mobility device 10. It also improves the user's posture by allowing the user to stand more upright, which in turn improves and extends the duration of time the user can stay active.

Another advantage of the use of four-bar linkage 62 is that it minimizes the size of personal mobility device 10, both when folded and unfolded. This facilitates use of personal mobility device in more confined or densely-populated spaces (e.g., social gatherings), or in spaces that require the user to reach in front of himself or herself (e.g., opening a kitchen cupboard). The reduced size may also encourage increased adoption of personal mobility device 10 relative to extant devices by minimizing the stigma and/or embarrassment that many users feel. In addition, the reduced size when folded allows personal mobility device 10 to be more easily stored in a confined space, such as a closet or vehicle trunk, and/or parked in crowded areas, such as the lobby of a restaurant, theater, or other public location. In embodiments, the space required to store multiple personal mobility devices 10 can be reduced by nesting (e.g., in the manner of shopping carts) or stacking (e.g., in the manner of folding chairs) the same.

Still another advantage of the use of four-bar linkage 62 is that it allows the user to have more leverage on seat 60. This facilitates the use of seat 60 to engage parking brake 72, as discussed with reference to FIG. 8.

Figure 8:
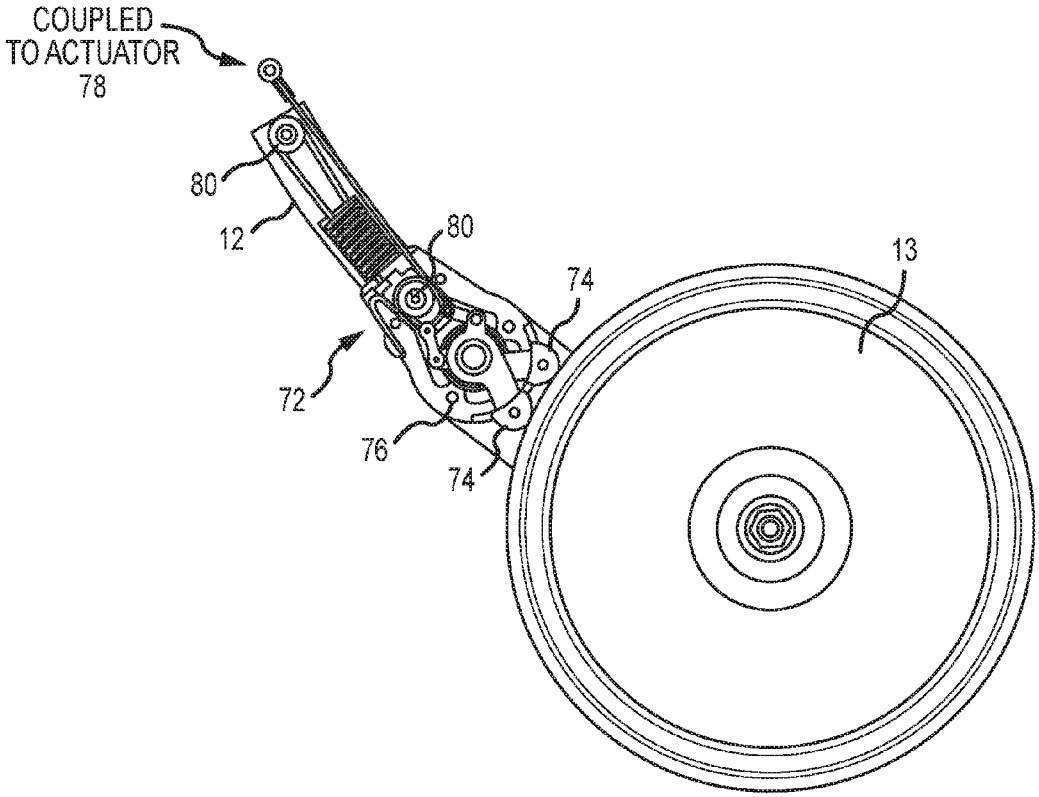
FIG. 8 depicts a parking brake, such as disclosed herein in connection with the personal mobility device of FIG. 1.

As shown in FIG. 8, parking brake 72 includes a plurality of brake shoes 74 adjacent first rear wheel 13. Although FIG. 8 depicts two brake shoes 74, this depiction should not be considered limiting, as parking brake 72 could be implemented with more or fewer brake shoes 74 without departing from the scope of the instant disclosure.

Brake shoes 74 are movable between an undeployed configuration, in which they are not in contact with first rear wheel 13, and a deployed configuration, in which they are in contact with first rear wheel 13. The deployed configuration of brake shoes 74 is shown in FIG. 8; in the undeployed configuration, brake shoes 74 can be retracted into brake housing 76.

Advantageously, brake shoes 74 are deployed in such a way that efforts to move first rear wheel 13 in either direction increase the force applied by brake shoes 74 by further wedging the corresponding brake shoe 74 between first rear wheel 13 and brake housing 76.

Brake shoes 74 can be toggled between the deployed configuration and the undeployed configuration via an actuator 78 within first hub 22, such as shown in FIG. 7. To provide increased mechanical advantage, actuator 78 can be coupled to brake shoes 74 via a plurality of pulleys 80 (e.g., a block-and-tackle arrangement), which are desirably contained within first rear leg 12 as shown in FIG. 8.

As those of ordinary skill in the art will appreciate from FIG. 7, when seat 60 is moved into the use position, bar 62*a* of four-bar linkage 62 will engage actuator 78 and deploy brake shoes 74 against first rear wheel 13. This configuration ensures that a user cannot sit in seat 60 without engaging parking brake 72.

Actuator 78 can also be biased (e.g., via a torsion spring within first hub 22) into the position shown in FIG. 7, associated with a disengaged state of parking brake 72 (e.g., the undeployed configuration of brake shoes 74). Thus, moving seat 60 into the stowed position will disengage bar 62*a* of four-bar linkage 62 from actuator 78 and retract brake shoes 74, thereby disengaging parking brake 72 without further user intervention.

It is also contemplated that actuator 78 can be moved into a third position, past where it is moved by seat 60 in the use position, associated with manual engagement of parking brake 72. This allows personal mobility device 10 to be parked with seat 60 in the stowed position. In addition, by allowing actuator 78 to move past the point it reaches when actuated by the deployment of seat 60 and into this third position, the chance of a user pinching his or her fingers between actuator 78 and seat 60 is minimized.

With seat 60 in the use position and parking brake 72 engaged, handle 20 can be used as a backrest. For user comfort, grip portion 26 of handle 20 can include a centrally-located flattened region 82, shown in FIGS. 1 and 6.

Figure 9:
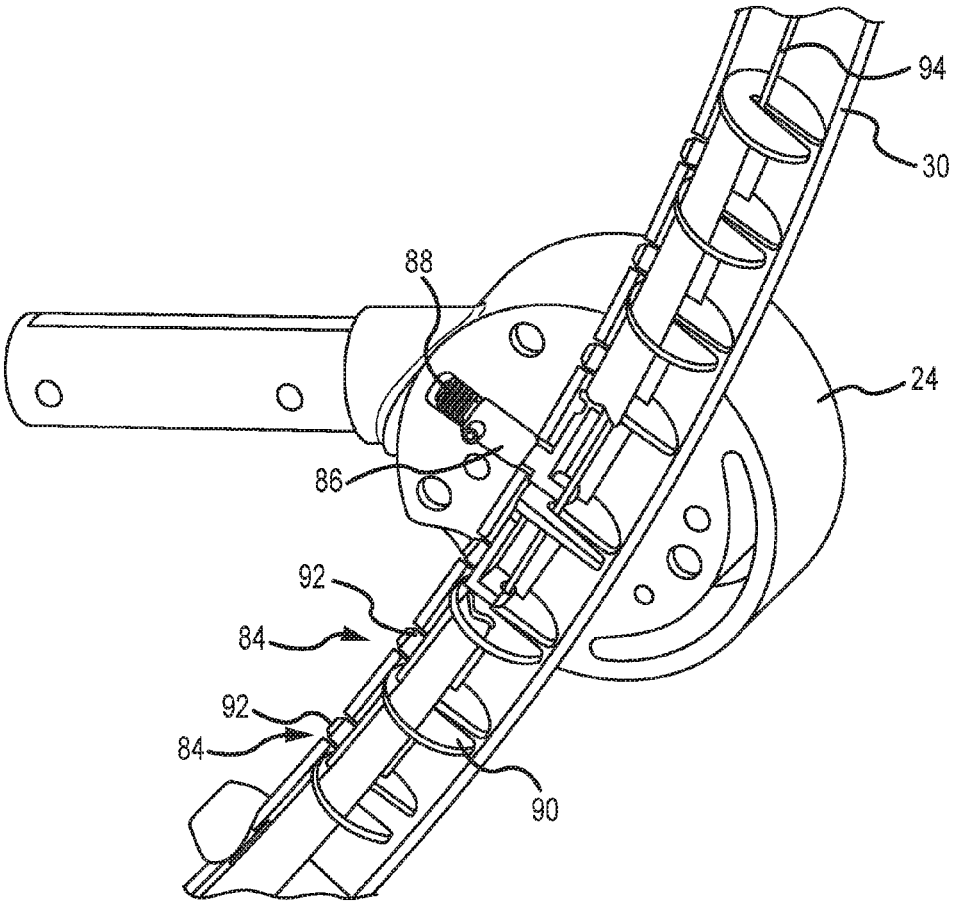
FIG. 9 depicts a mechanism to adjust the height of the grip portion of the handle of the personal mobility device shown in FIG. 1.

The height of grip portion 26 can also be adjusted for user comfort (e.g., raised for walking and lowered for sitting). As shown in FIG. 9, handle 20 includes a plurality of detent holes 84 in vertical members 28, 30, with each detent hole 84 corresponding to a respective height of grip portion 26 as handle 20 slides upwardly and downwardly through first and second hubs 22, 24 (FIG. 9 only shows second hub 24 and vertical member 30). To lock grip portion 26 at a preset height, second hub 24 includes a grip height locking pin 86, which is biased by spring 88 to engage detent holes 84.

To adjust the height of grip portion 26, grip height locking pin 86 must first be ejected from detent hole 84. In embodiments, handle 20 includes a spine 90 of interconnected pegs 92 respectively positioned adjacent detent holes 84. A cable 94 runs along spine 90 and is connected at one end to a trigger 96, shown in FIGS. 1 and 6, proximate grip portion 26. Depressing trigger 96 places cable 94 in tension, which, due to the curvature of vertical member 30, forces spine 90 outward and causes pegs 92 to protrude from their respectively adjacent detent holes 84. This also forces grip height locking pin 86 from detent hole 84, allowing handle 20 to slide freely through second hub 24 in either direction. Advantageously, as long as trigger 96 remains depressed, grip height locking pin 86 will not be able to reengage a detent hole 84.

Figure 10:
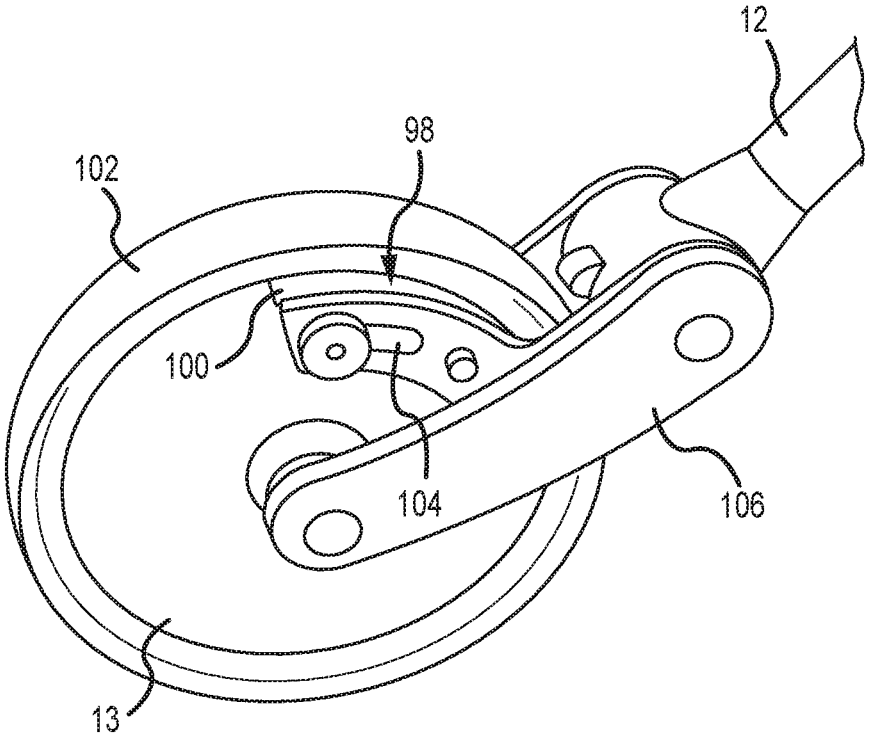
FIG. 10 depicts a passive brake, such as disclosed herein in connection with the personal mobility device of FIG. 1.
Figure 11A:
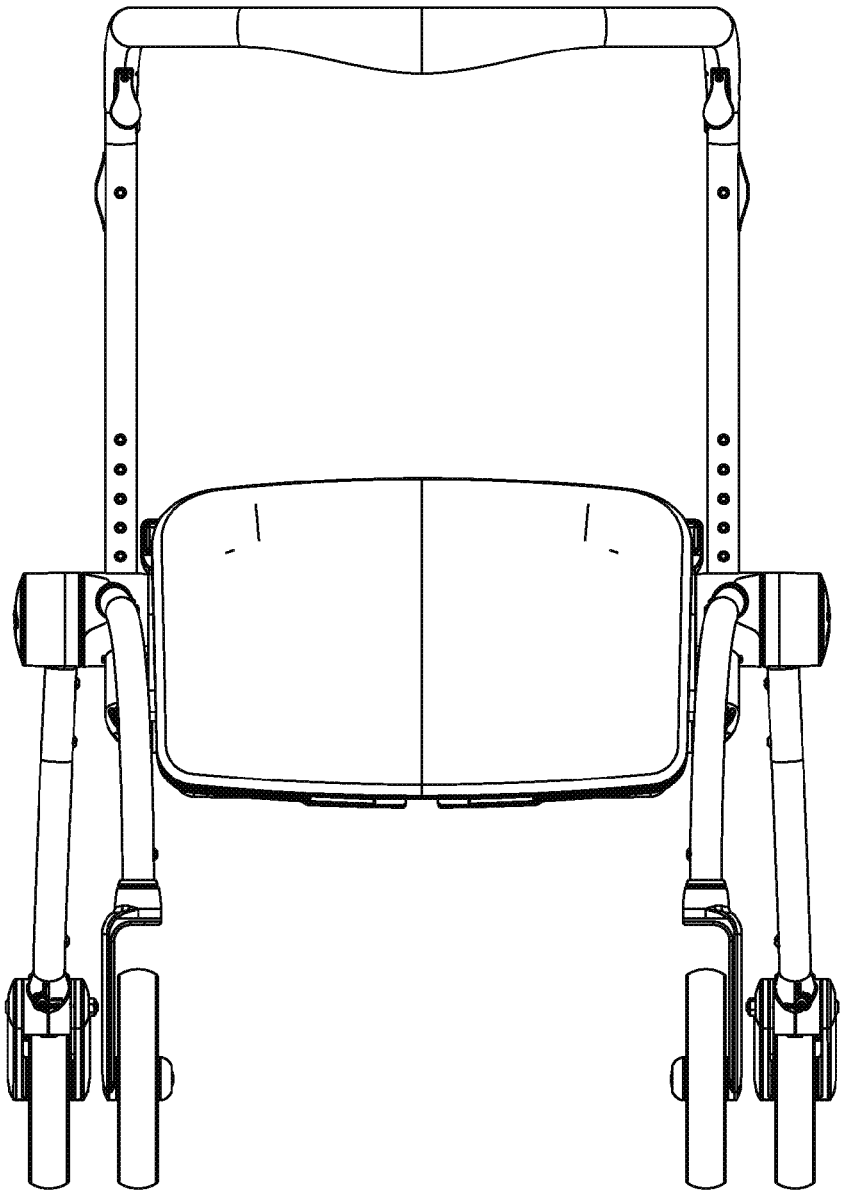
FIGS. 11A-11G, 12A-12G, and 13A-13G are additional views of an embodiment of a personal mobility device according to the instant teachings that illustrate various aesthetic aspects thereof. In particular.
Figure 11B:
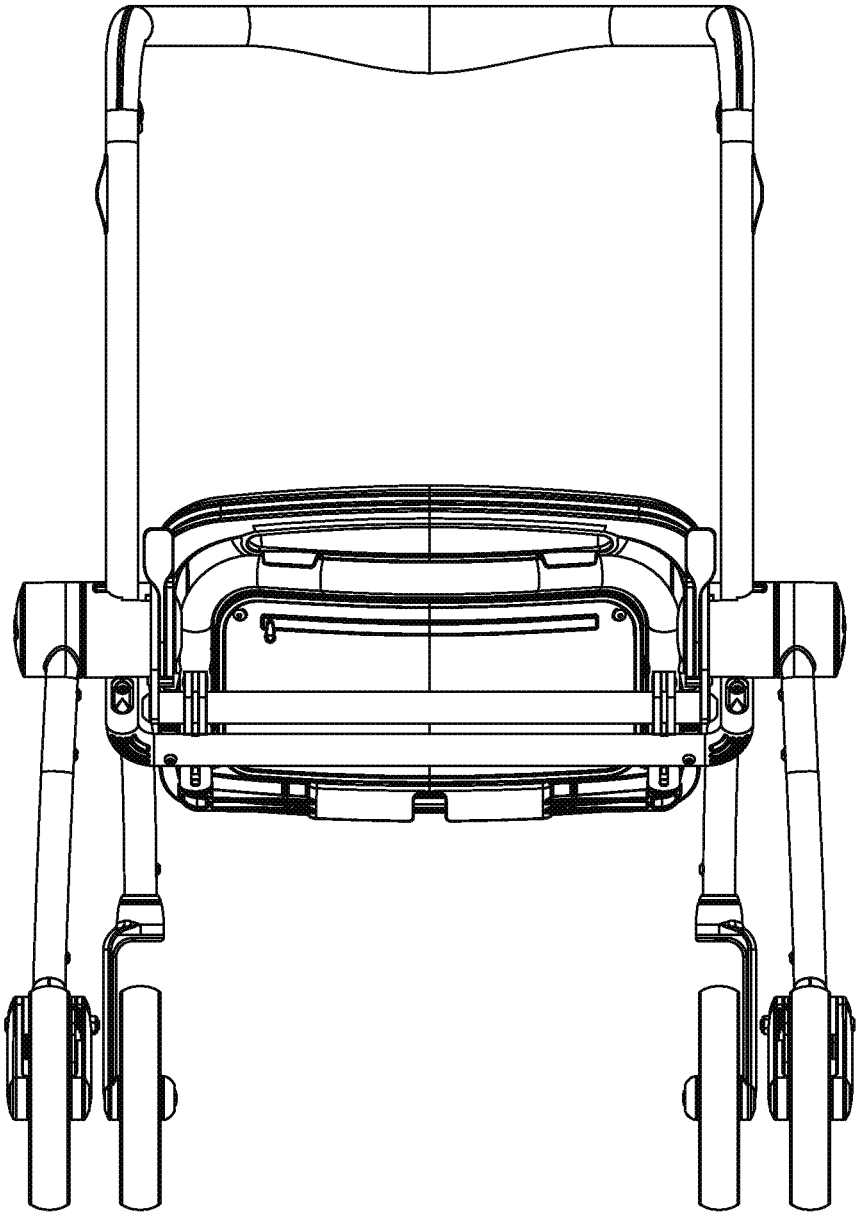
Figure 11C:
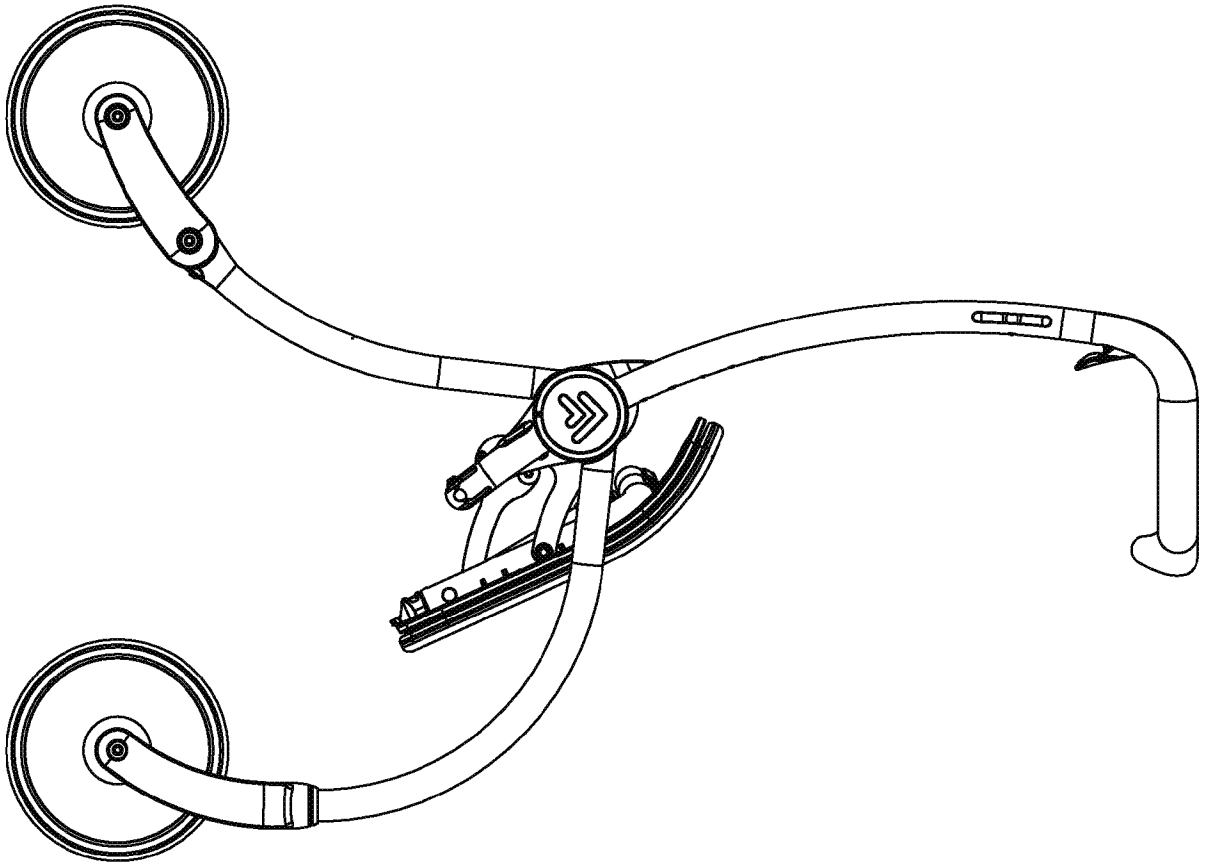
Figure 11D:
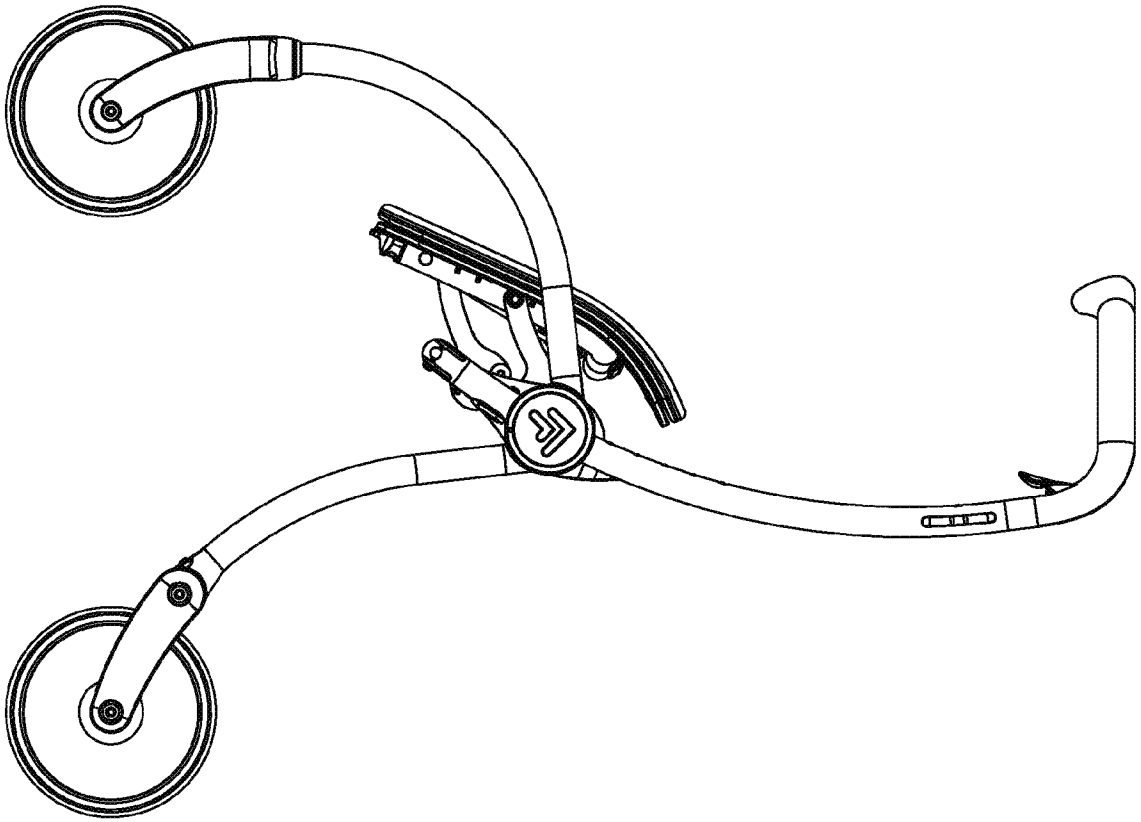
Figure 11E:
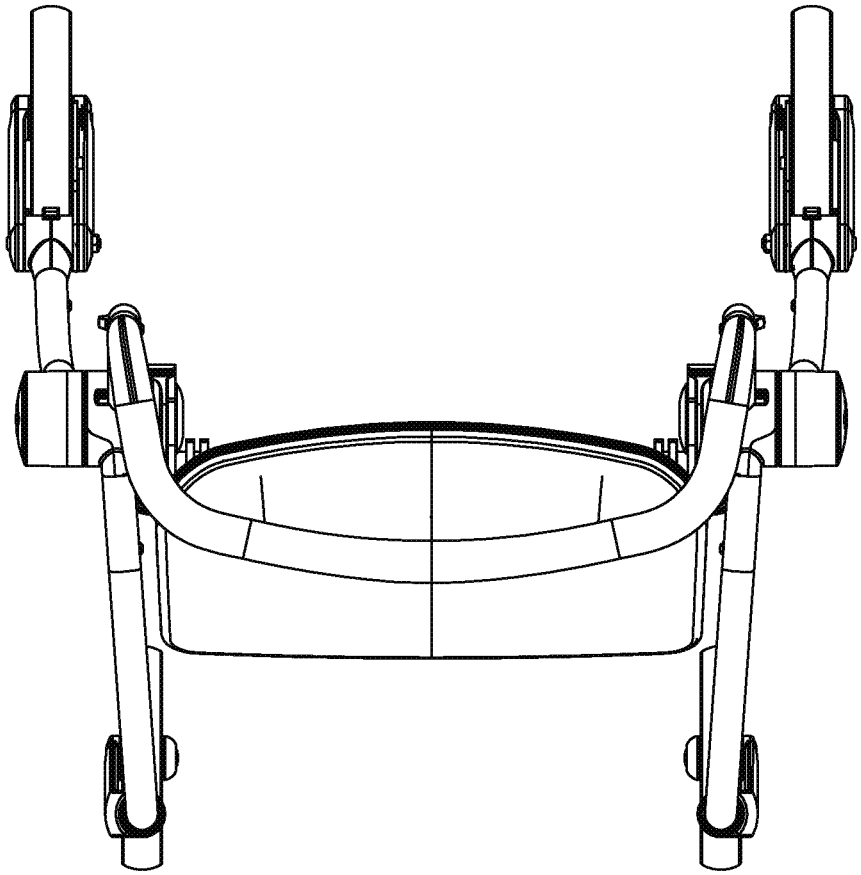
Figure 11F:
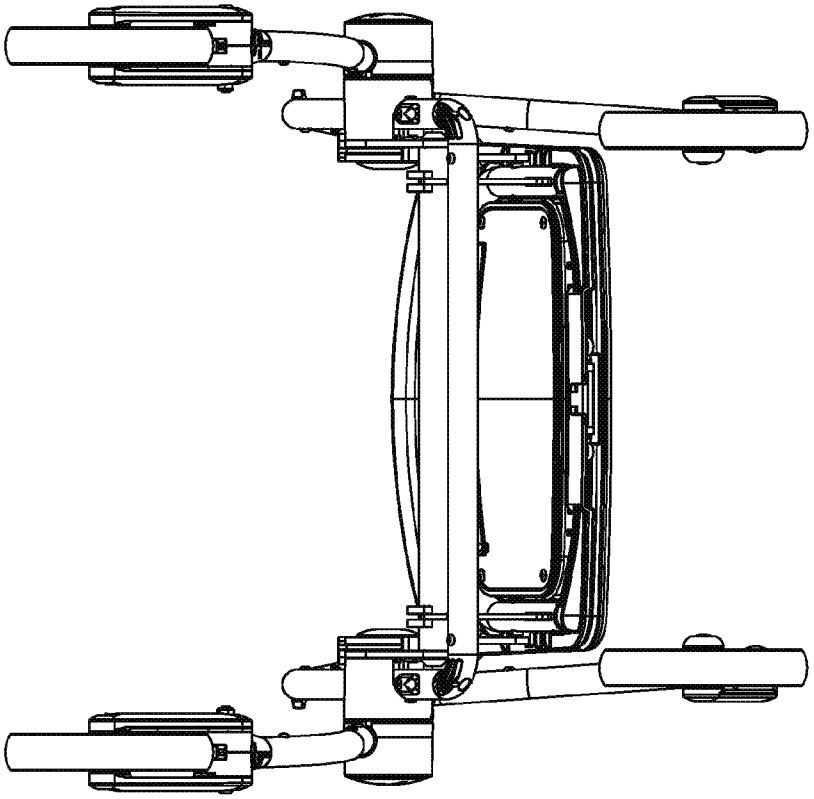
Figure 11G:
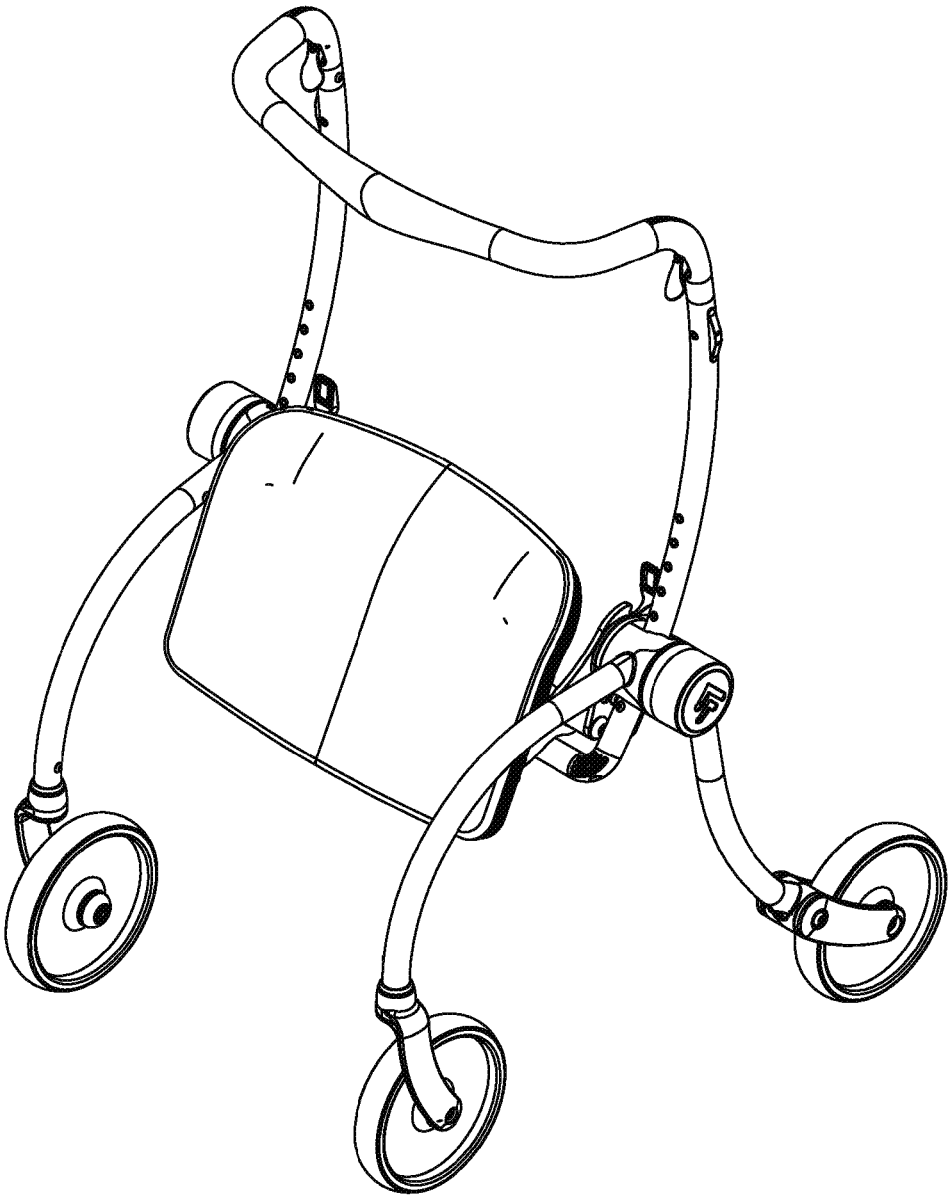
Figure 12A:
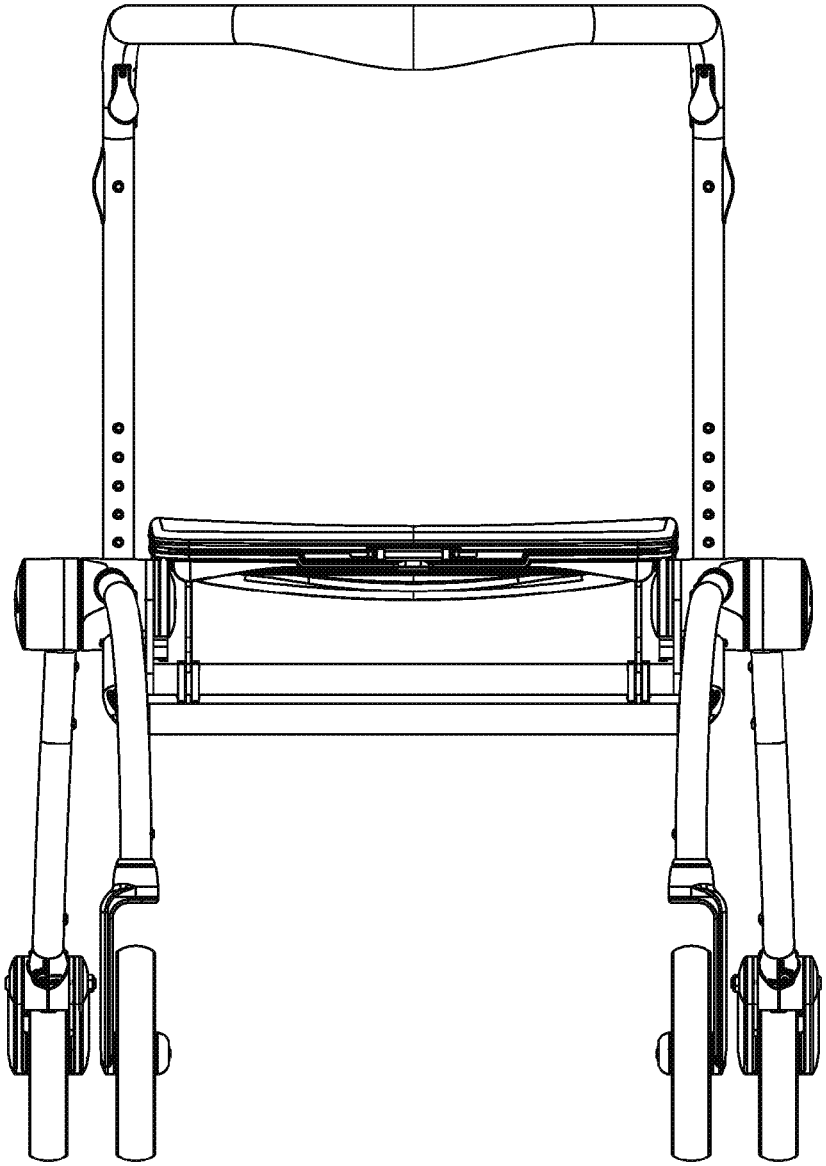
Figure 12B:
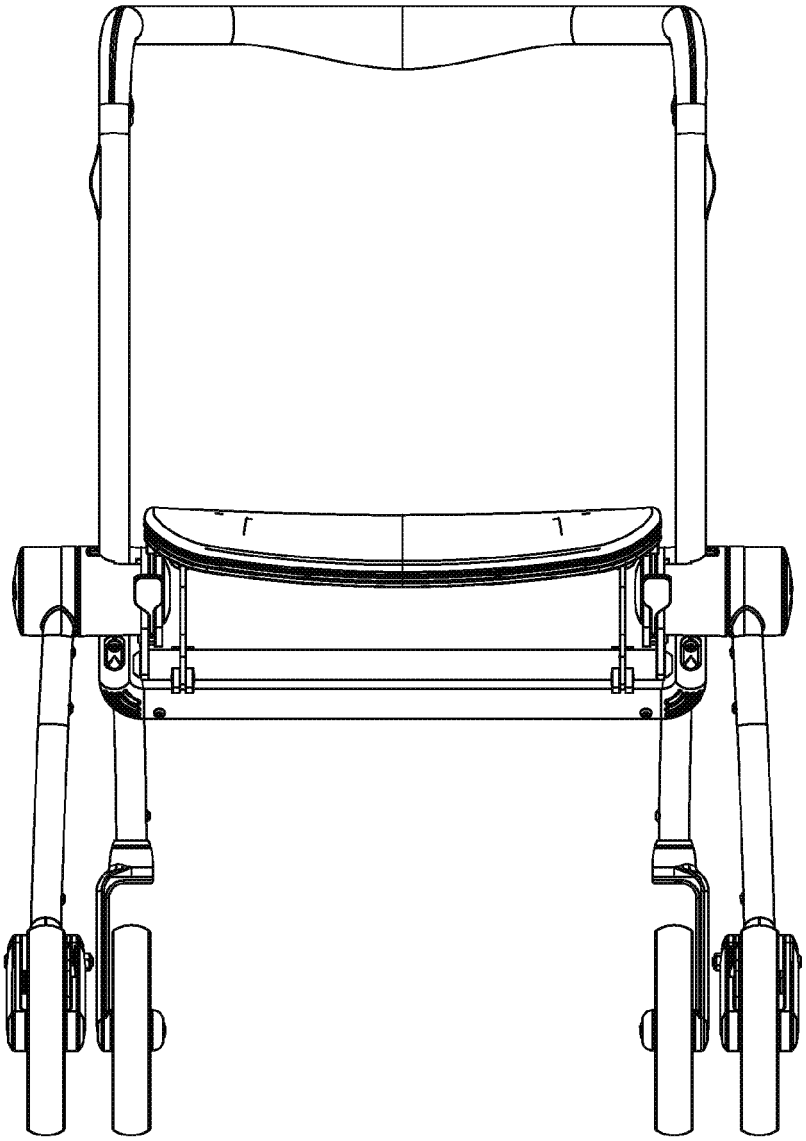
Figure 12C:
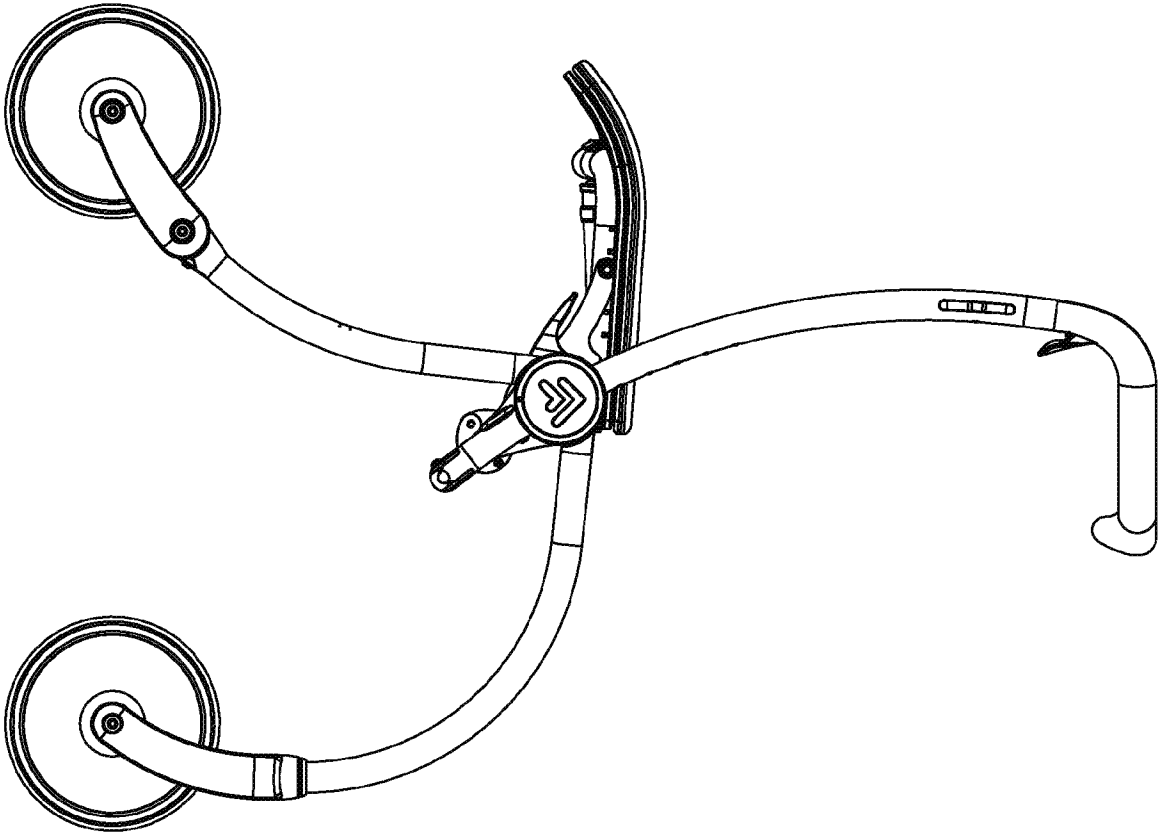
Figure 12D:
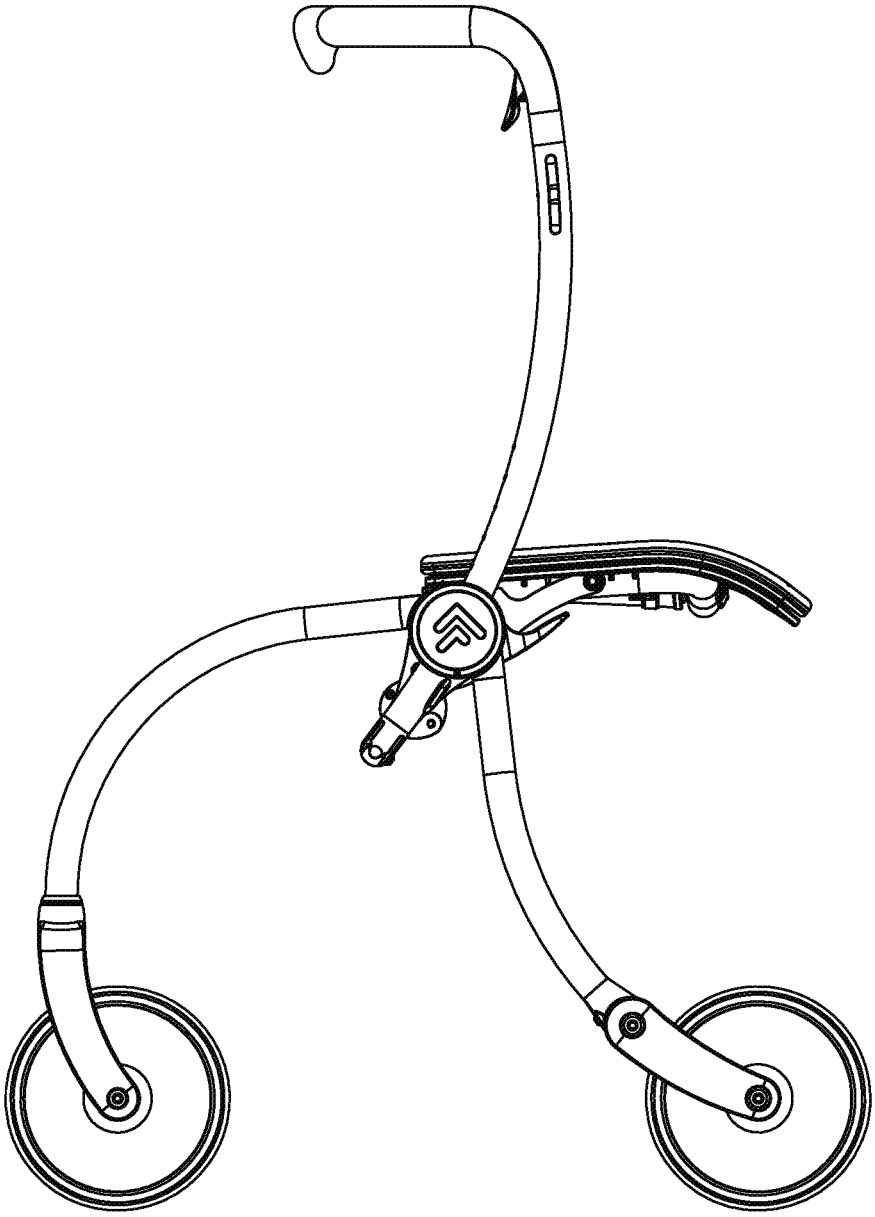
Figure 12E:
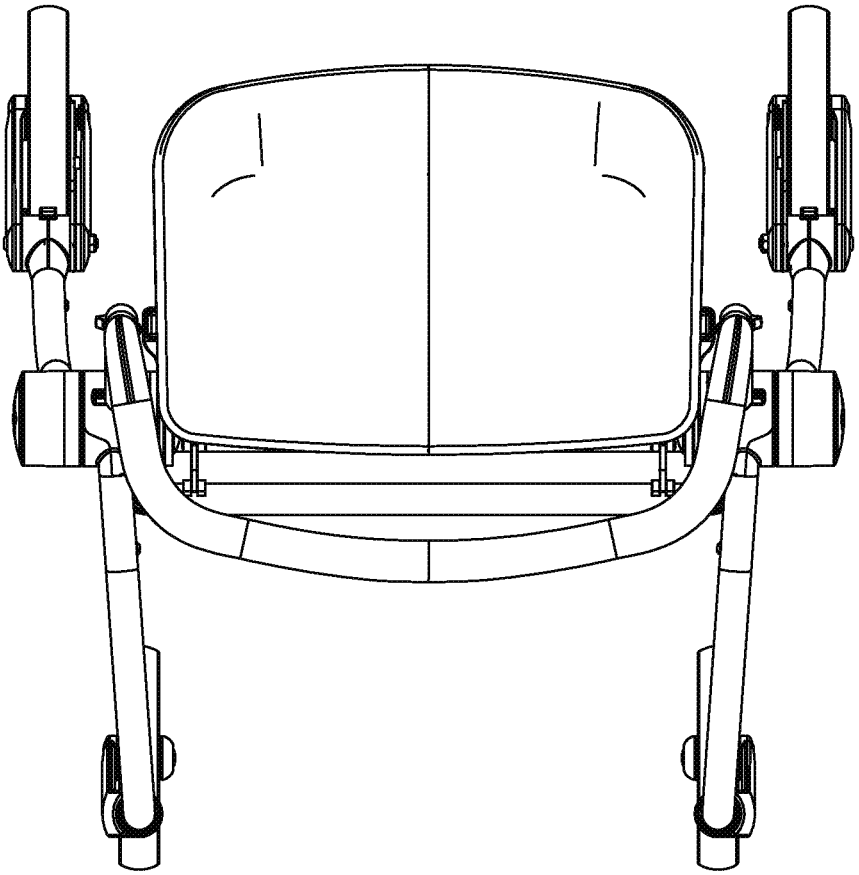
Figure 12F:
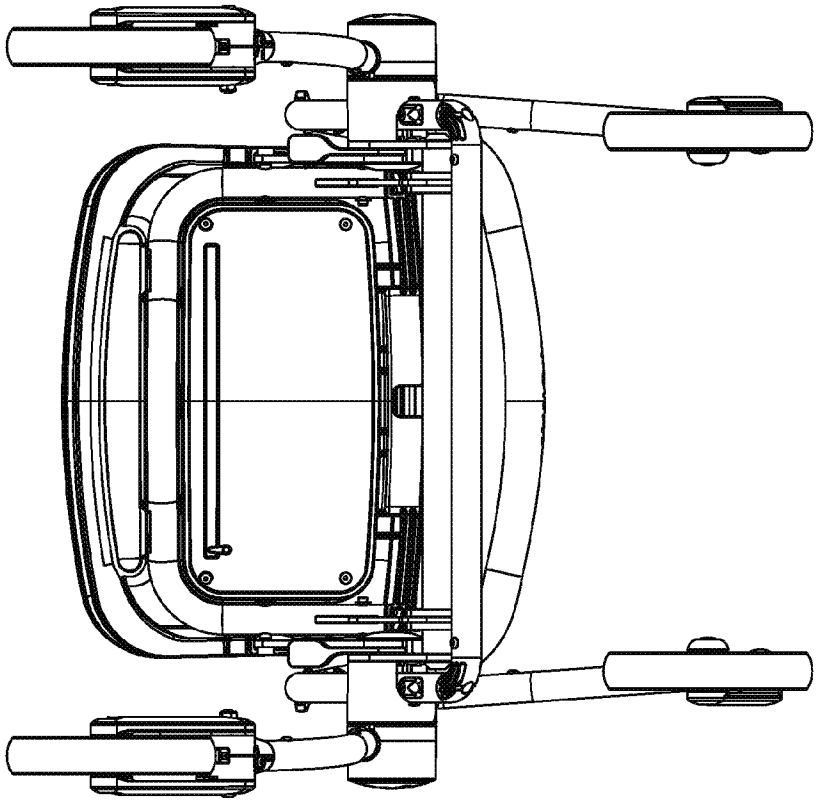
Figure 12G:
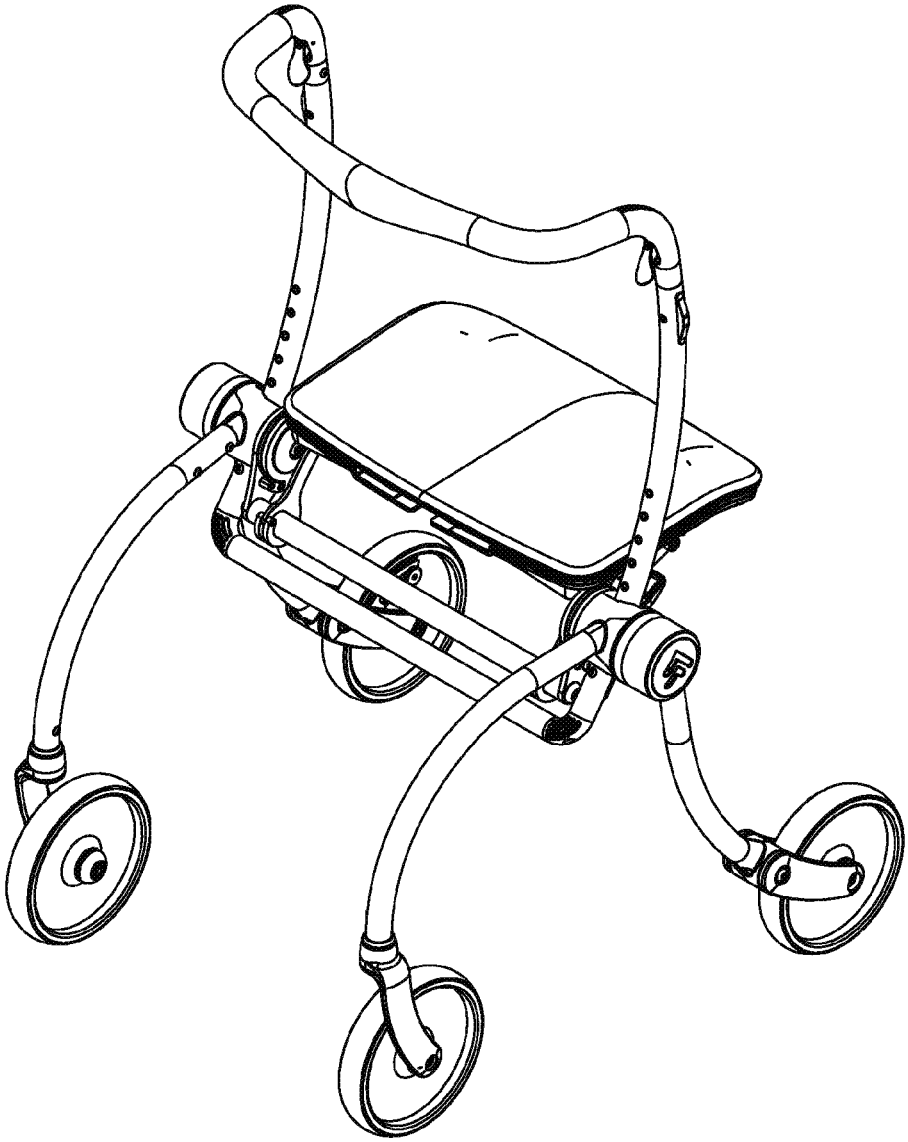
Figure 13A:
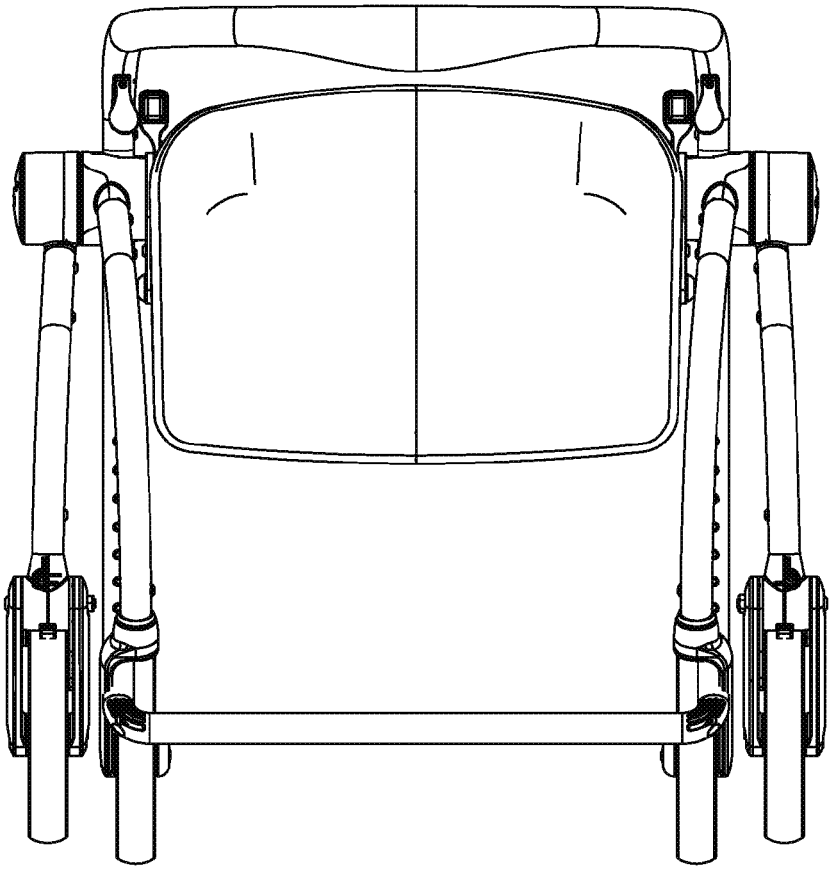
Figure 13B:
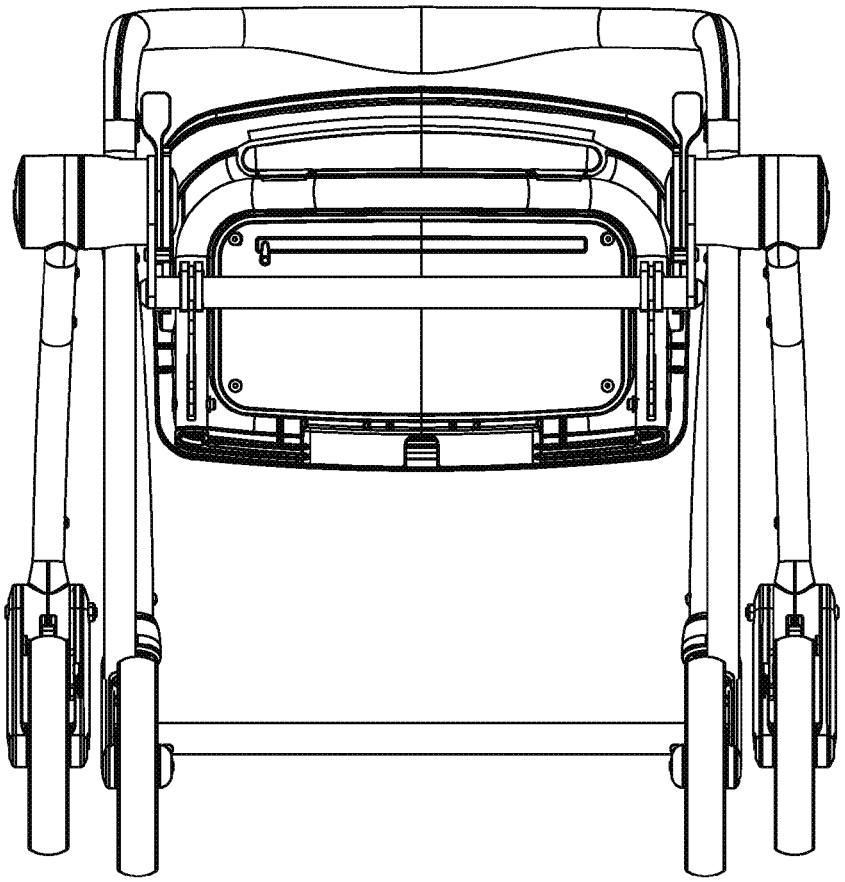
Figure 13C:
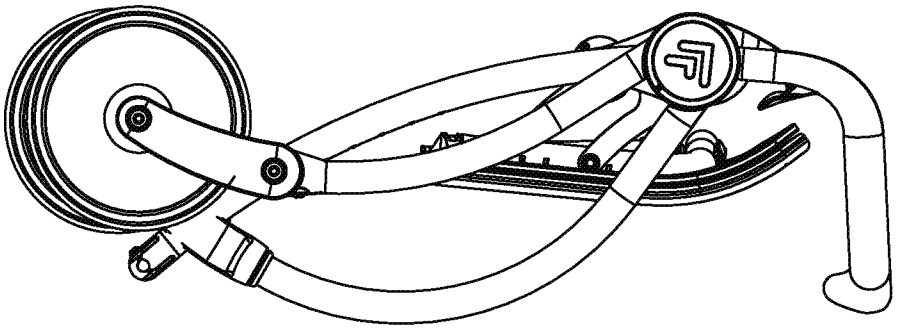
Figure 13D:
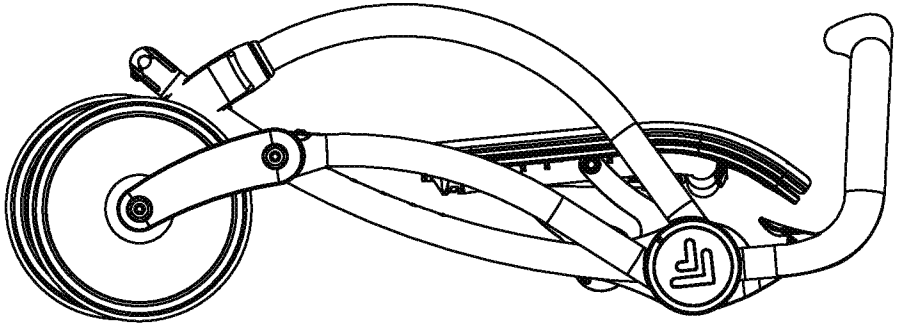
Figure 13E:
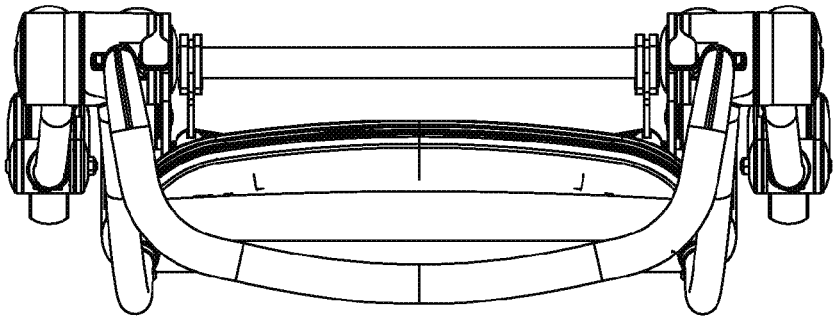
Figure 13F:
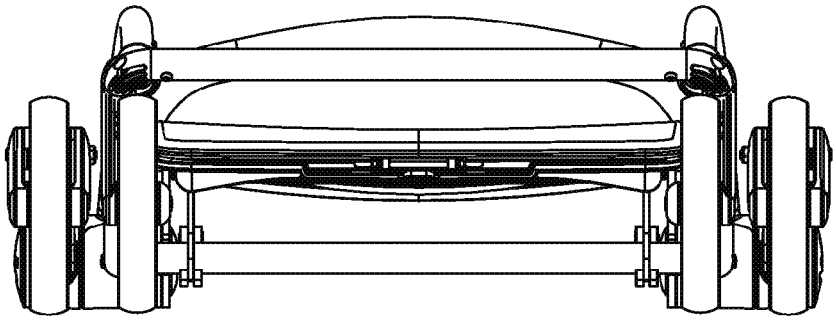
Figure 13G:
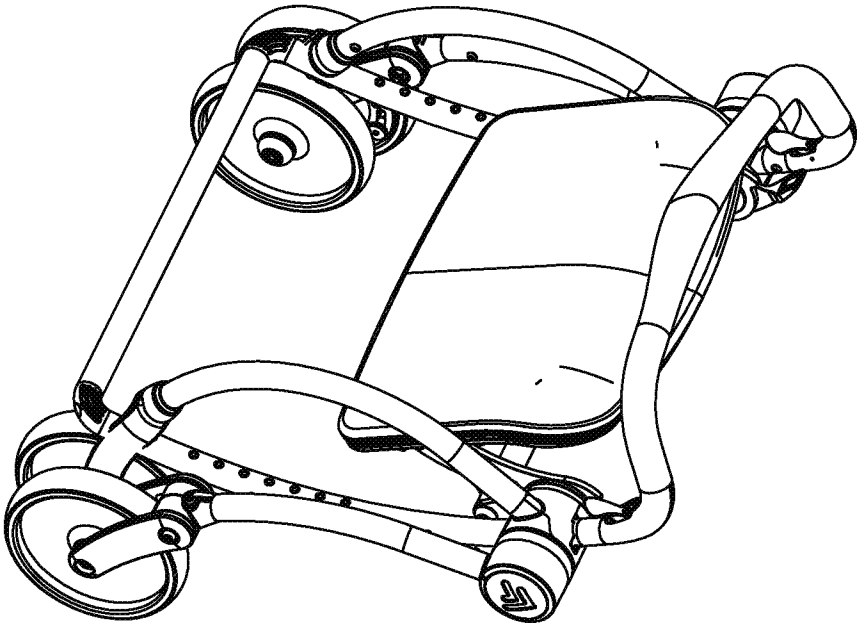

In further embodiments of the disclosure, personal mobility device 10 includes a passive braking system as an alternative or in addition to parking brake 72 described above. For purposes of illustration, FIG. 10 depicts a passive brake 98 in connection with first rear wheel As shown in FIG. 10, passive brake 98 includes a brake shoe 100 biased (e.g., by a coil spring) into engagement with first rear wheel 13. According to aspects of the disclosure, brake shoe 100 engages an inner, upper surface of first rear wheel 13. In particular, the tire 102 on first wheel 13 can be overmolded around the rim of first rear wheel 13 such that brake shoe 100 engages the material of tire 102.

When a user exerts a downward force on personal mobility device 10, for example by leaning on grip portion 26, brake shoe 100 will disengage from first rear wheel 13, allowing personal mobility device 10 to move. When the downward force is removed, brake shoe 100 will re-engage first rear wheel 13, stopping personal mobility device 10. This passive braking is advantageous when a user must remove both hands from personal mobility device 10 to perform a task, such as opening a door, because it prevents personal mobility device 10 from rolling away when not held. In addition, it offers improved stability on downwardly-inclined surfaces. Passive brake 98 can also be disabled, for example by sliding brake shoe 100 along slot 104.

Passive brake 98 can also act as a suspension for personal mobility device 10. Put another way, the same coil spring that biases brake shoe 100 into contact with first rear wheel 13 also allows first rear wheel 13 to "float" relative to fork 106. This helps ensure that first rear wheel 13 remains in contact with the ground, compensating for uneven ground and providing shock absorption capabilities.

Another advantage of passive brake 98 is that it does not require cabling, as do the braking systems in many extant mobility devices. This reduces the maintenance burden and provides increased safety relative to extant mobility devices.

Although several embodiments have been described above with a certain degree of particularity, those skilled in the art could make numerous alterations to the disclosed embodiments without departing from the spirit or scope of this invention.

For example, seat 60 can be modular and detachable from frame 70.

As another example, a storage pouch can be provided under seat 60. Advantageously, unlike extant mobility devices, such a storage pouch can remain full when personal mobility device 10 is folded, because the contents will not interfere with the collapse of handle 20 and legs 12, 14, 16, and 18.

As yet another example, wheels 13, 15 and/or wheel assemblies 17, 19 can be removable. Indeed, if all four are removed, personal mobility device 10 can be used as a four-point walker and/or a stationary chair. Similarly, if rear wheels 13, 15 are locked (e.g., by deploying parking brakes 72 and/or passive brakes 98 thereagainst), personal mobility device 10 can be used as a two-point rolling walker. As a patient regains function, a therapist could gradually reduce the friction applied to rear wheels 13, 15 until they are freely rotatable.

As still another example, though many features of the disclosure have been described only in connection with one side of personal mobility device 10 or the other, it should be understood that the principles disclosed can be applied bilaterally without departing from the scope of the instant disclosure.

Likewise, though many features of the disclosure have been described in connection with either the front wheels or the rear wheels of personal mobility device 10, it should be understood that the principles disclosed can be applied to both the front wheels and the rear wheels of personal mobility device 10 without departing from the scope of the instant disclosure.

A further advantage of personal mobility device 10 is that it is more aesthetically appealing than extant mobility devices. This can incentivize greater use by those in need. FIGS. 11A-13G are additional views of an embodiment of personal mobility device 10 according to the teachings herein that illustrate various aesthetic aspects thereof Yet another advantage of personal mobility device 10 is that all, or nearly all, required hardware (e.g., springs, cabling, and the like) are internal to components (e.g., disposed within hubs 22, 24 and/or legs 12, 14).

All directional references (e.g., upper, lower, upward, downward, left, right, leftward, rightward, top, bottom, above, below, vertical, horizontal, clockwise, and counter-clockwise) are only used for identification purposes to aid the reader's understanding of the present invention, and do not create limitations, particularly as to the position, orientation, or use of the invention. Joinder references (e.g., attached, coupled, connected, and the like) are to be construed broadly and may include intermediate members between a connection of elements and relative movement between elements. As such, joinder references do not necessarily infer that two elements are directly connected and in fixed relation to each other.

It is intended that all matter contained in the above description or shown in the accompanying drawings shall be interpreted as illustrative only and not limiting. Changes in detail or structure may be made without departing from the spirit of the invention as defined in the appended claims.

What is claimed is:

1. A personal mobility device, comprising:

a first rear leg;

a second rear leg;

a first front leg pivotably connected to the first rear leg by a first hub, wherein the first hub has a first state, wherein the first rear leg and the first front leg are locked in an open configuration; a second state, wherein the first rear leg and the first front leg are locked in a closed configuration; and a third state, wherein the first rear leg and the first front leg are unlocked to pivot between the open configuration and the closed configuration;

a second front leg pivotably connected to the second rear leg by a second hub, wherein the second hub has a first state, wherein the second rear leg and the second front leg are locked in an open configuration; a second state, wherein the second rear leg and the second front leg are locked in a closed configuration; and a third state, wherein the second rear leg and second front leg are unlocked to pivot between the open configuration and the closed configuration; and a handle, having a loop shape and including a grip portion, slidably mounted within the first hub and the second hub such that a height of the grip portion is adjustable, wherein sliding the handle through the first hub toggles the first hub between either the first state or the second state and the third state, and sliding the handle through the second hub toggles the second hub between either the first state or the second state and the third state.

2. The personal mobility device according to claim 1, wherein:

sliding the handle downwardly through the first hub toggles the first hub between the first state of the first hub and the third state of the first hub, and sliding the handle downwardly through the second hub toggles the second hub between the first state of the second hub and the third state of the second hub.

3. The personal mobility device according to claim 1, wherein:

sliding the handle upwardly through the first hub toggles the first hub between the second state of the first hub and the third state of the first hub, and sliding the handle upwardly through the second hub toggles the second hub between the second state of the second hub and the third state of the second hub.

4. The personal mobility device according to claim 1, wherein:

the first hub comprises a first follower that, when depressed, toggles the first hub into the second state;

the second hub comprises a second follower that, when depressed, toggles the second hub into the second state; and the handle comprises a first cam to depress the first follower and a second cam to depress the second follower.

5. The personal mobility device according to claim 4, wherein:

the first cam comprises a wedge to depress the first follower as the handle slides downwardly through the first hub and to depress the first follower as the handle slides upwardly through the first hub; and the second cam comprises a wedge to depress the second follower as the handle slides downwardly through the second hub to depress the second follower as the handle slides upwardly through the second hub.

6. The personal mobility device according to claim 1, further comprising:

a first swiveling wheel assembly including a first wheel attached to the first front leg; and a second swiveling wheel assembly including a second wheel attached to the front rear leg, wherein the handle has a curvature such that, when the handle is slid downwardly through the first hub and the second hub, it engages the first swiveling wheel assembly and the second swiveling wheel assembly in a manner that positions the first wheel parallel to the second wheel and prevents swiveling of the first swiveling wheel assembly and the second swiveling wheel assembly.

7. The personal mobility device according to claim 1, further comprising:

a first wheel attached to the first rear leg;

a second wheel attached to the second rear leg;

a first brake shoe adjacent the first wheel and movable between an undeployed configuration, wherein the first brake shoe is not in contact with the first wheel, and a deployed configuration, wherein the first brake shoe is in contact with the first wheel;

a second brake shoe adjacent the second wheel and movable between an undeployed configuration, wherein the second brake shoe is not in contact with the second wheel, and a deployed configuration, wherein the second brake shoe is in contact with the second wheel;

a first actuator in the first hub operable to toggle the first brake shoe between the undeployed configuration and the deployed configuration; and a second actuator in the second hub operable to toggle the second brake shoe between the undeployed configuration and the deployed configuration.

8. The personal mobility device according to claim 1, wherein:

the first hub comprises a first grip height locking pin;

the second hub comprises a second grip height locking pin; and the handle comprises a plurality of detents to engage the first grip height locking pin and the second grip height locking pin as the handle slides through the first hub and the second hub in order to secure the grip portion of the handle at a preset height.

9. The personal mobility device according to claim 1, further comprising:

a first wheel attached to the first rear leg;

a second wheel attached to the second rear leg;

a first brake shoe biased into engagement with the first wheel; and a second brake shoe biased into engagement with the second wheel.

10. The personal mobility device according to claim 9, wherein the first brake shoe engages an inner, upper surface of the first wheel and the second brake shoe engages an inner, upper surface of the second wheel.

11. The personal mobility device according to claim 9, wherein a downward force applied to the grip portion of the handle causes the first brake shoe to disengage the first wheel and the second brake shoe to disengage the second wheel.

12. The personal mobility device according to claim 1, wherein the handle comprises a closed loop.

13. The personal mobility device according to claim 1, wherein the grip portion of the handle comprises a centrally-located flattened region.

14. A personal mobility device, comprising:

a first rear leg;

a second rear leg;

a first front leg pivotably connected to the first rear leg by a first hub;

a second front leg pivotably connected to the second rear leg by a second hub;

a handle, having a loop shape and including a grip portion, slidably mounted within the first hub and the second hub such that a height of the grip portion is adjustable;

a first swiveling wheel assembly including a first wheel attached to the first front leg; and a second swiveling wheel assembly including a second wheel attached to the front rear leg, wherein the handle has a curvature such that, when the handle is slid downwardly through the first hub and the second hub, it engages the first swiveling wheel assembly and the second swiveling wheel assembly in a manner that positions the first wheel parallel to the second wheel and prevents swiveling of the first swiveling wheel assembly and the second swiveling wheel assembly.

15. A personal mobility device, comprising:

a first rear leg;

a second rear leg;

a first front leg pivotably connected to the first rear leg by a first hub;

a second front leg pivotably connected to the second rear leg by a second hub;

a handle, having a loop shape and including a grip portion, slidably mounted within the first hub and the second hub such that a height of the grip portion is adjustable;

a first wheel attached to the first rear leg;

a second wheel attached to the second rear leg;

a first brake shoe adjacent the first wheel and movable between an undeployed configuration, wherein the first brake shoe is not in contact with the first wheel, and a deployed configuration, wherein the first brake shoe is in contact with the first wheel;

a second brake shoe adjacent the second wheel and movable between an undeployed configuration, wherein the second brake shoe is not in contact with the second wheel, and a deployed configuration, wherein the second brake shoe is in contact with the second wheel;

a first actuator in the first hub operable to toggle the first brake shoe between the undeployed configuration and the deployed configuration; and a second actuator in the second hub operable to toggle the second brake shoe between the undeployed configuration and the deployed configuration.

16. The personal mobility device according to claim 15, wherein:

the first actuator is coupled to the first brake shoe through a first plurality of pulleys; and the second actuator is coupled to the second brake shoe through a second plurality of pulleys.

17. The personal mobility device according to claim 15, further comprising a seat movable between a stowed position and a use position, wherein moving the seat from the stowed position to the use position actuates the first actuator to toggle the first brake shoe into the deployed configuration and actuates the second actuator to toggle the second brake shoe into the deployed configuration.

18. The personal mobility device according to claim 17, wherein the seat is pivotably coupled to the first hub and the second hub.

19. The personal mobility device according to claim 15, wherein:

the first actuator is biased to toggle the first brake shoe into the undeployed configuration, and the second actuator is biased to toggle the second brake shoe into the undeployed configuration.

20. A personal mobility device, comprising:

a first rear leg;

a second rear leg;

a first front leg pivotably connected to the first rear leg by a first hub;

a second front leg pivotably connected to the second rear leg by a second hub; and a handle, having a loop shape and including a grip portion, slidably mounted within the first hub and the second hub such that a height of the grip portion is adjustable, wherein:

the first hub comprises a first grip height locking pin;

the second hub comprises a second grip height locking pin; and the handle comprises a plurality of detents to engage the first grip height locking pin and the second grip height locking pin as the handle slides through the first hub and the second hub in order to secure the grip portion of the handle at a preset height.

21. The personal mobility device according to claim 20, wherein the handle further comprises:

a plurality of pegs internal to the handle and respectively positioned adjacent the plurality of detents; and an actuator operable to move the plurality of pegs such that they respectively protrude outwardly from the plurality of detents, thereby preventing the first grip height locking pin and the second grip height locking pin from engaging the plurality of detents as the handle slides through the first hub and the second hub in order to adjust the height of the grip portion of the handle.

22. The personal mobility device according to claim 21, wherein at least some of the plurality of pegs are interconnected with each other.

* * * * *